US011043061B2

(12) United States Patent
Vazquez et al.

(10) Patent No.: US 11,043,061 B2
(45) Date of Patent: Jun. 22, 2021

(54) DISPENSER OF SHELVED PRODUCTS

(71) Applicant: Swyft Inc., San Francisco, CA (US)

(72) Inventors: Diego Vazquez, Antioch, CA (US); Lincoln Smith, San Francisco, CA (US); Gower Smith, San Francisco, CA (US)

(73) Assignee: Swyft Inc., San Francisco, CA (US)

( * ) Notice: Subject to any disclaimer, the term of this patent is extended or adjusted under 35 U.S.C. 154(b) by 0 days.

(21) Appl. No.: 16/530,928

(22) Filed: Aug. 2, 2019

(65) Prior Publication Data

US 2020/0043273 A1 Feb. 6, 2020

Related U.S. Application Data

(60) Provisional application No. 62/713,976, filed on Aug. 2, 2018, provisional application No. 62/721,450, filed on Aug. 22, 2018.

(51) Int. Cl.
*G07F 11/42* (2006.01)

(52) U.S. Cl.
CPC ..... *G07F 11/42* (2013.01)

(58) Field of Classification Search
None
See application file for complete search history.

(56) References Cited

U.S. PATENT DOCUMENTS 9,443,372 B2 9/2016 Mockus et al.
2007/0021866 A1* 1/2007 Coppola ..... G07F 11/42 700/231
2012/0123587 A1* 5/2012 Mockus ..... G07F 11/24 700/230
2012/0277904 A1* 11/2012 Pritchard ..... G07F 9/02 700/232
2015/0189364 A1 7/2015 Into

FOREIGN PATENT DOCUMENTS

CN 206411788 U 8/2017
JP 2000105864 A 4/2000

OTHER PUBLICATIONS

Notification and Transmittal of International Search Report and Written Opinion, PCT/US2019/045007, dated Oct. 24, 2019, 8 pages.
PCT International Preliminary Report on Patentability in Application PCT/US2019/045007, dated Feb. 11, 2021, 8 pages.

* cited by examiner

*Primary Examiner* — Gene O Crawford
*Assistant Examiner* — Ayodeji T Ojofeitimi
(74) *Attorney, Agent, or Firm* — Merchant & Gould P.C.

(57) ABSTRACT

Methods and apparatuses provide a vending machine with a dispenser the moves product from a shelf to a conveyor bucket. The dispenser includes an elongate divider with a drive gear at its bucket end. A drive gear from the bucket engages the dispenser drive gear causing a linear positioner to move a carriage along the elongate divider and toward the bucket. The movement causes product on the shelf, and between the carriage and the bucket, to be forced into the bucket.

20 Claims, 19 Drawing Sheets

DISPENSER OF SHELVED PRODUCTS

CROSS-REFERENCE TO RELATED CASES

The present application claims priority to U.S. Provisional Patent Application No. 62/713,976, entitled "Dispenser Of Shelved Products," filed on Aug. 2, 2018, and to U.S. Provisional Application No. 62/721,450, also entitled "Dispenser Of Shelved Products," filed on Aug. 22, 2018, which are both incorporated by reference.

TECHNICAL FIELD

The present subject matter relates to the field of vending machines and more particularly to methods and apparatus for moving products within vending machines.

BACKGROUND

Current vending machine designs can typically be grouped into two distinct categories; those that display the products to be dispensed, and those that do not. Primary considerations in development of vending machines include the reliability of the mechanism to dispense a selected product each time it is selected by a consumer as well as the efficiency of the machine in terms of the variety and capacity of SKUs offered for the cost and size of the machine. Data suggests that vending machines that display products for sale generate higher sales than those with closed fronts that hide the actual product being offered for sale and instead substitute branding and advertising panels. Traditionally, many vending machine designs such as those for popular beverage brands from Coke and Pepsi had closed fronts and opted for a branding panel instead of a glass front to display a showcase of the products for sale. More recently vending machines have become more sophisticated and are being used to sell higher value products such as electronics, cosmetics, and other higher value consumer items. In retail applications it has been desirable to have a design of a machine that displays the products available for sale to consumers. The most popular recent designs allow products to be assorted on shelves in merchandise displays akin to retail shelves. In such designs, consumers can see the products available to be dispensed and can select them via a user interface for immediate delivery. Early designs of such systems comprised shelves with dividers and with a dispensing mechanism such as a spiral dispenser that would push the product from the shelf to the dispense bin. More recent designs have incorporated a robotic fetch mechanism that could engage with mechanical assemblies on the shelf to dispense products from the shelf to the delivery bin. The more recent designs aimed to make the vending machine product showcase more like a retail shelf than a mechanical vending machine apparatus. However to ensure that the vending machine mechanics served their primary purpose of firstly displaying products available for sale and secondly ensuring a mechanism that allowed the product to be reliably dispensed to consumers, the vending machines to date have typically incorporated a shelf and display system where the dispensing mechanism is visibly obvious to consumers. Typical retail store shelf dividers are of a minimal width to ensure that the product being displayed on shelf gets maximum visibility. Retail store shelf dividers are typically no more than 0.5 to 1 cm in width. In contrast, the narrowest vending machine shelf divider with a dispensing mechanism known at the time of filing was 1.9 cm in wide. Such a divider is more obvious to the human eye as being obtrusive.

It is therefore desirable to have shelf dispenser that increases the capacity of the shelf by reducing the overall width, and therefore the overall forward-facing dispenser surface area, of the dispenser. Furthermore, it is desirable to have a shelf dispenser that may interact with sensors to allow the vending machine to determine the location of the dispenser, the number of products in each dispenser area, and, from that information, the inventory of the vending machine.

BRIEF DESCRIPTION OF THE DRAWINGS

The embodiments are illustrated by way of example and not limitation in the figures of the accompanying drawings, in which like references indicate similar elements, and in which.

DETAILED DESCRIPTION

Figure 1:
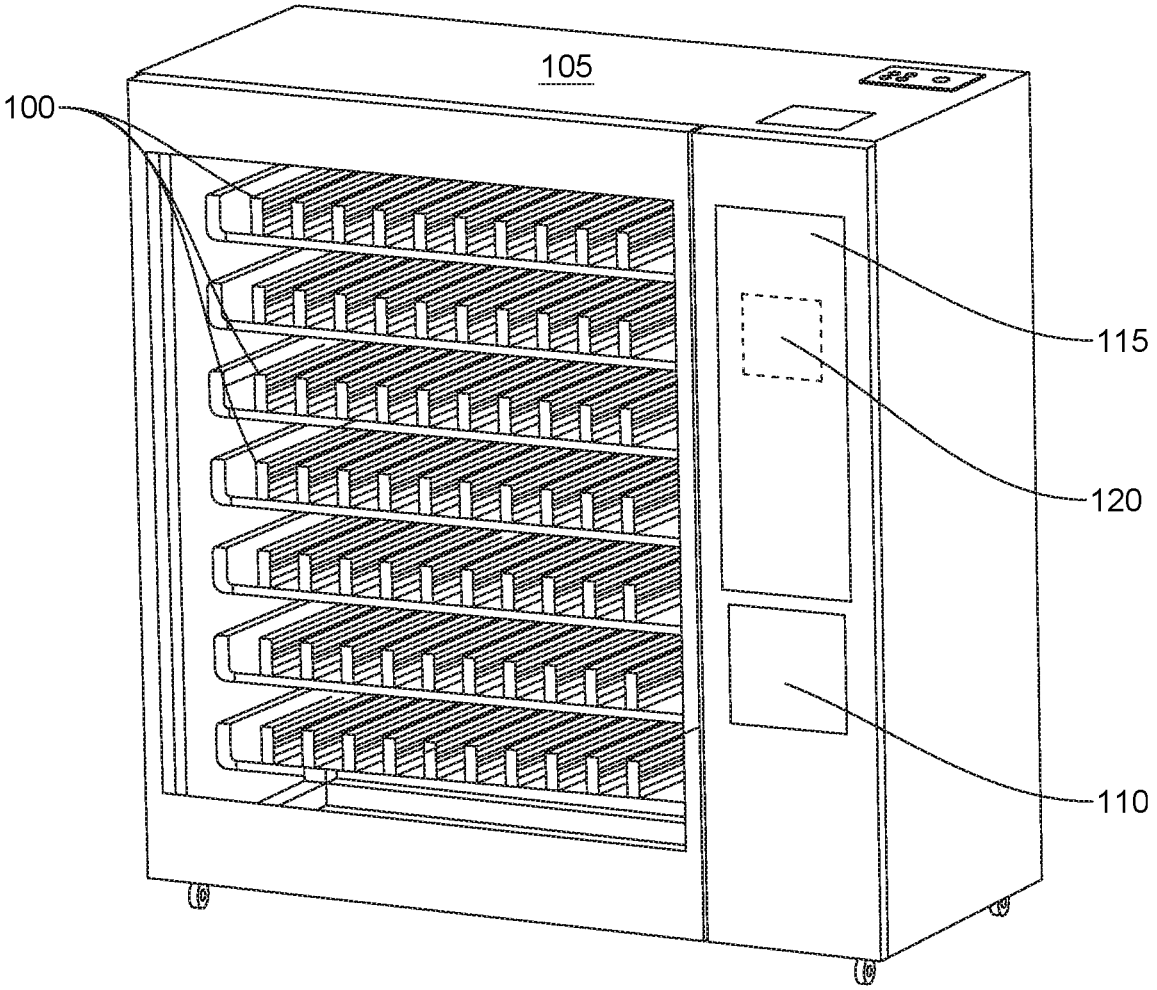
FIG. 1 is a perspective view depicting an embodiment of dispensers of shelved products incorporated into a vending machine.

Embodiments of the dispenser of shelved products guide, support, dispense, and stabilize products in the shelf of a vending machine. Embodiments increase the capacity of the shelf by reducing the overall width of the divider and all components that constitute this unit.

In an embodiment of a dispenser, the width is significantly reduced, almost halved to 1.1 cm, while still incorporating all of the functional features of the dispenser, which allows for the display of merchandise in vending machine that more closely mimics the traditional display of merchandise in a retail store.

Furthermore, in an embodiment, changes to a pusher transmission reduce the space required by the one-piece gear and timing pulley (e.g., gear/pulley 430, FIG. 4) being used in combination with a drive gear (e.g., drive gear 350, FIG. 3) where the width of the one-piece gear/pulley and the width of the drive gear are the same. In other words, the divider need only be dimensioned to accommodate the width of the drive gear (e.g., drive gear 350), and not the combined width of a drive gear and a pulley (as if a pulley were added directly to drive gear 350). In the embodiment, a combination of train gears includes two front gears of ratio 1 to 1, the first gear (e.g., drive gear 350, FIG. 3) being a simple gear for coupling to the drive motor, and the other gear being a combination of thin gear and a pulley (e.g., gear/pulley 430) to drive the pusher carriage.

In an embodiment, the clockwise direction of rotation of the drive gear allows embodiments to be used in existing machines without the need for changes in the control system.

In an embodiment, a belt tensioner is included for tensioning the transmission belt. The tensioner keeps all the components together without the need to use tools to assemble the divider unit. (See FIG. 8 in which the tension of belt 370 may be used to keep belt tensioner 390 and front end 320 in place in divider track 380 without the need for additional fasteners.)

In an embodiment, a front end of the dispenser has a set of flat springs that allow the stabilization of small size products at the front end (which is the dispensing area). The flat springs provide lateral pressure to retain packets at the front edge of the dispenser and prevent them from falling off the front edge of the shelf due to, e.g., vibration caused by bucket movement.

In an embodiment, the frontal coupling of the dispenser to the vending machine shelf is included on the top surface of the shelving where the products sit (upper front part of the shelving), eliminating a space between the front edge of the shelving and the transporting bucket. (See FIG. 5 and FIG. 6, which show front end 320 in line with the front edge of the shelf.) These coupling points on the shelf are designed as very thin and very short holes that are aligned perpendicular to the front of the product or front face of the shelf, so as to act as guides for the travel of the product during the dispense process as opposed to being parallel where they may cause products to catch on the edge of the hole and create issues during the dispense process. The dispenser mechanism includes two thin, flat hooks that clip into these holes underneath the front edge of the dispenser, which therefore take up no extra surface area that is visible to the consumer.

In an embodiment, the pusher carriage is compact and allows the dispenser to support different lengths of pusher extension fins, which may be made of a lighter or cheaper material, and easy to manufacture.

An embodiment has the advantage that with the same components it can be assembled on the left or on the right of the vending machine shelf without the need for tools. This feature allows adding more products on the right side of the shelves and increases the capacity of the machine. In the embodiment, the divider can be pre-assembled in two ways before it is inserted into the vending machine shelf. The parts are symmetrical, which provides the possibility of having two assembly configurations, left or right. In an embodiment, the extender bracket size varies depending on the size of the products, and it is not considered to be "symmetrical," since it must be manufactured specifically for right or left-hand installation.

In an embodiment, the geometry of the pusher carriage has been improved to have better stability, create less friction in the rail, and have fewer parts. For example, in an embodiment, the parts of the divider were designed to eliminate unwanted movements using a better clearance fit. This results in less play between the slider grooves and the rails of the divider, which results in the pusher carriage malfunctioning less often. The embodiment is more stable in the sense that it has better accuracy between the pusher and the rail. The pusher design has also been improved to allow the pusher to travel further on the rail, traveling further from the very back of the dispenser to the very front face of the dispenser, allowing for more product to sit on the shelf.

FIG. 1 is a perspective view depicting an embodiment of dispensers 100 of shelved products (not shown) incorporated into a vending machine 105. Vending machine 105 further includes a dispensing door 110 to which products are delivered by the vending machine and through which products are retrieved by the user. Vending machine 105 also includes a user interface 115 which allows a user to choose and pay for products, and a controller that receives input from the user interface and various sensors in the vending machine and which controls the various systems of the vending machine.

Figure 2:
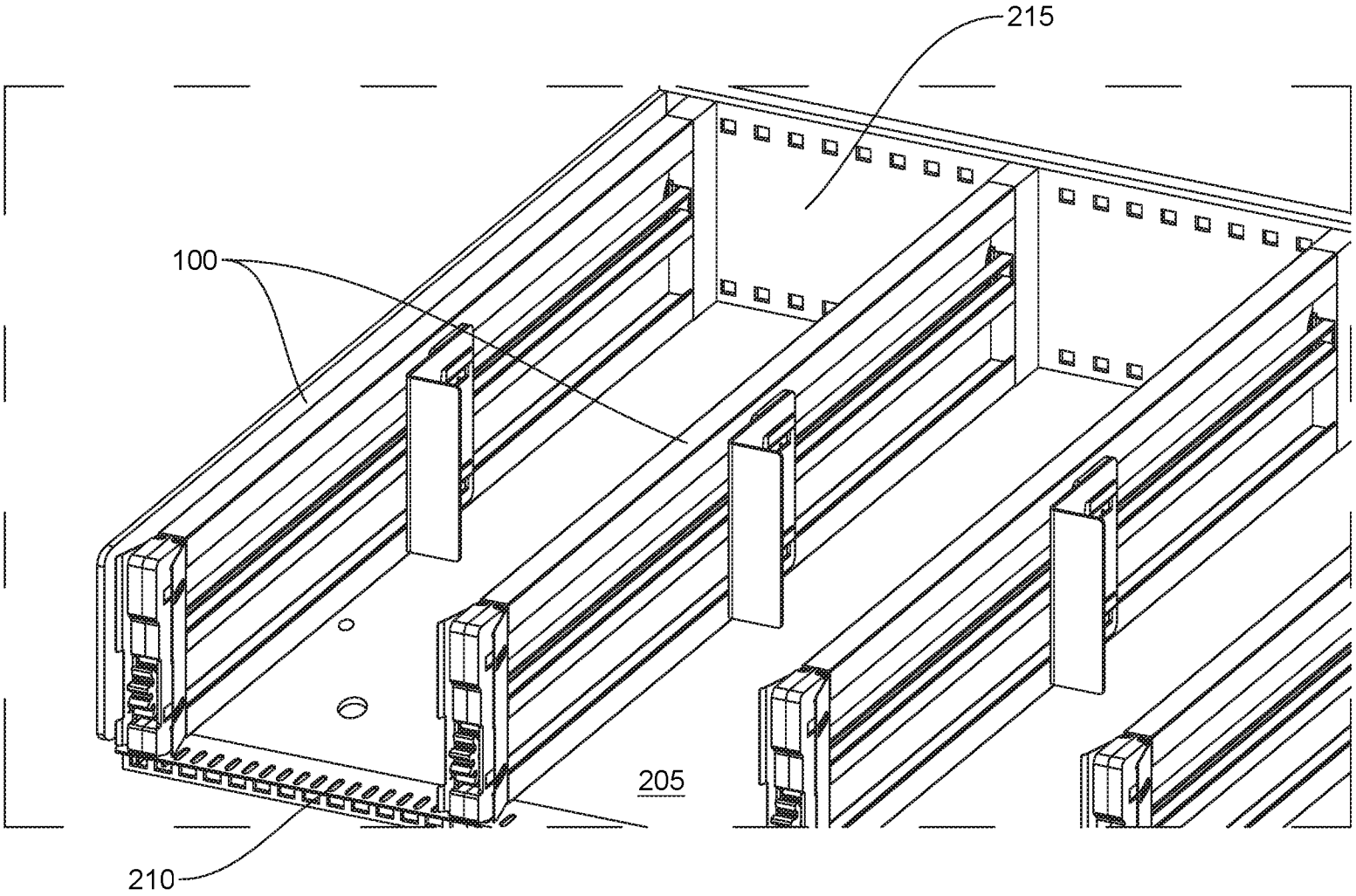
FIG. 2 is a perspective view depicting an embodiment of dispensers of shelved products on a shelf of a vending machine.

FIG. 2 is a perspective view depicting an embodiment of dispensers 100 of shelved products installed on a shelf 205 of a vending machine. In FIG. 2, dispensers 100 are attached to shelf 205 using front slots 210 and back slots 215.

Figure 3:
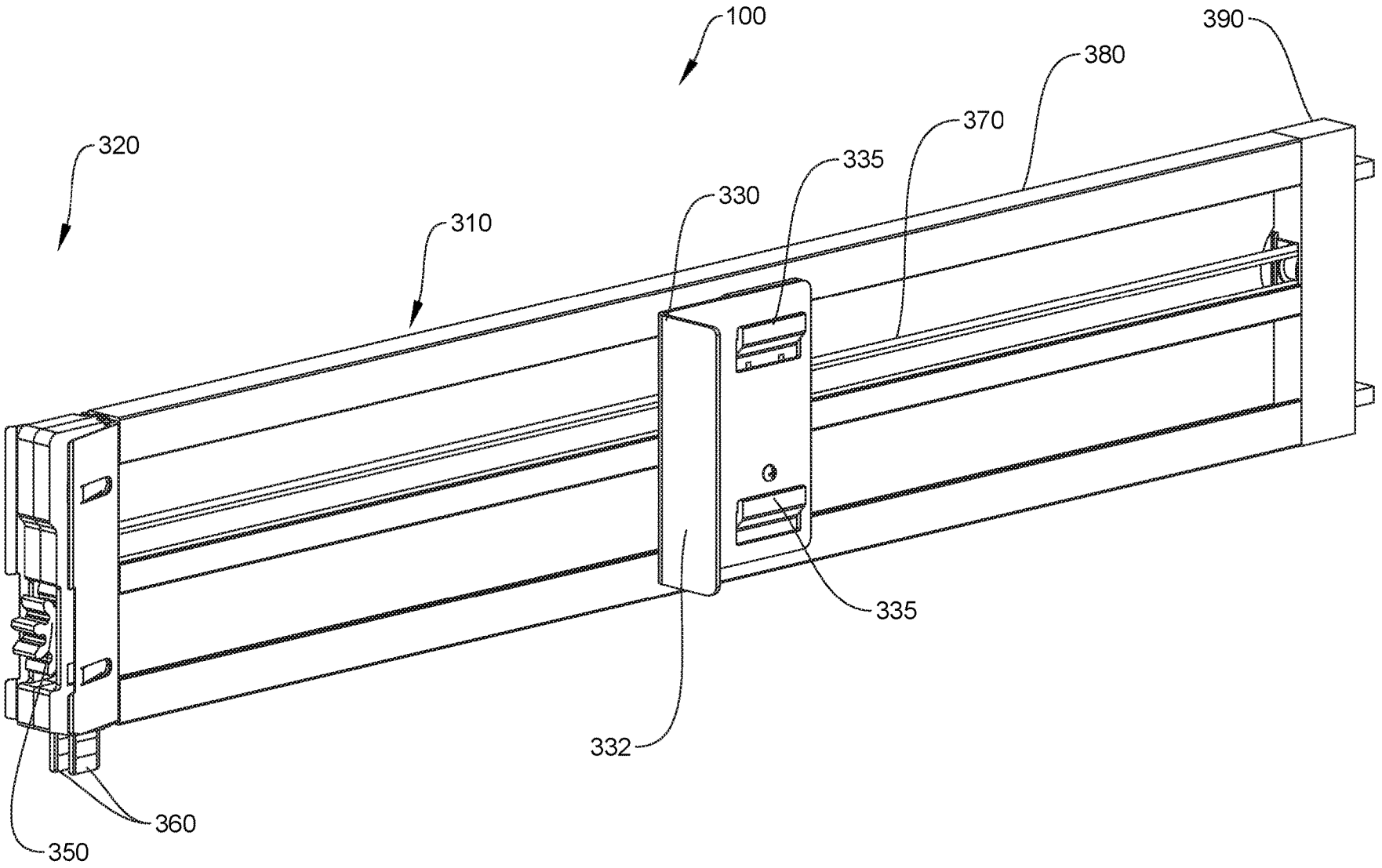
FIG. 3 is a perspective view depicting an embodiment of a dispenser of shelved products.

FIG. 3 is a perspective view depicting an embodiment of a dispenser of shelved products. In FIG. 3, dispenser 100 includes a divider 310 and an extender bracket 330. Divider 310 includes a front end 320, a timing belt 370, a pusher carriage (FIG. 4, element 410, obscured by extender bracket 330), and a belt tensioner 390. The obscured pusher carriage 410 connects extender bracket 330 to divider 310 using bracket hooks 335. The pusher carriage runs between front end 320 and belt tensioner 390. Front end 320 further includes flat spring retainers 340, a drive gear 350, and latch pins 360. Drive gear 350 engages a corresponding drive gear of the vending machine and provides the motive force to move timing belt 370. Timing belt 370 is connected to the obscured pusher carriage 410 and is drawn forward or backward according to the rotation of drive gear 350, which in turn positions extender bracket 330 along divider track 380. Latch pins 360 fit into slots 205 to retain dispenser 100 on shelf 205.

In an embodiment, extender brackets 330 may have different length extender faces 332 to accommodate different row dimensions (the distance between dispensers 100) or products of different dimensions. Thus, in an embodiment, a kit may include an individual dispenser 100 may be accompanied by a plurality of extender brackets with different extender face dimensions, the kit allowing the dispenser to be equipped with an extender bracket appropriate for a given row dimension or given product.

Figure 4:
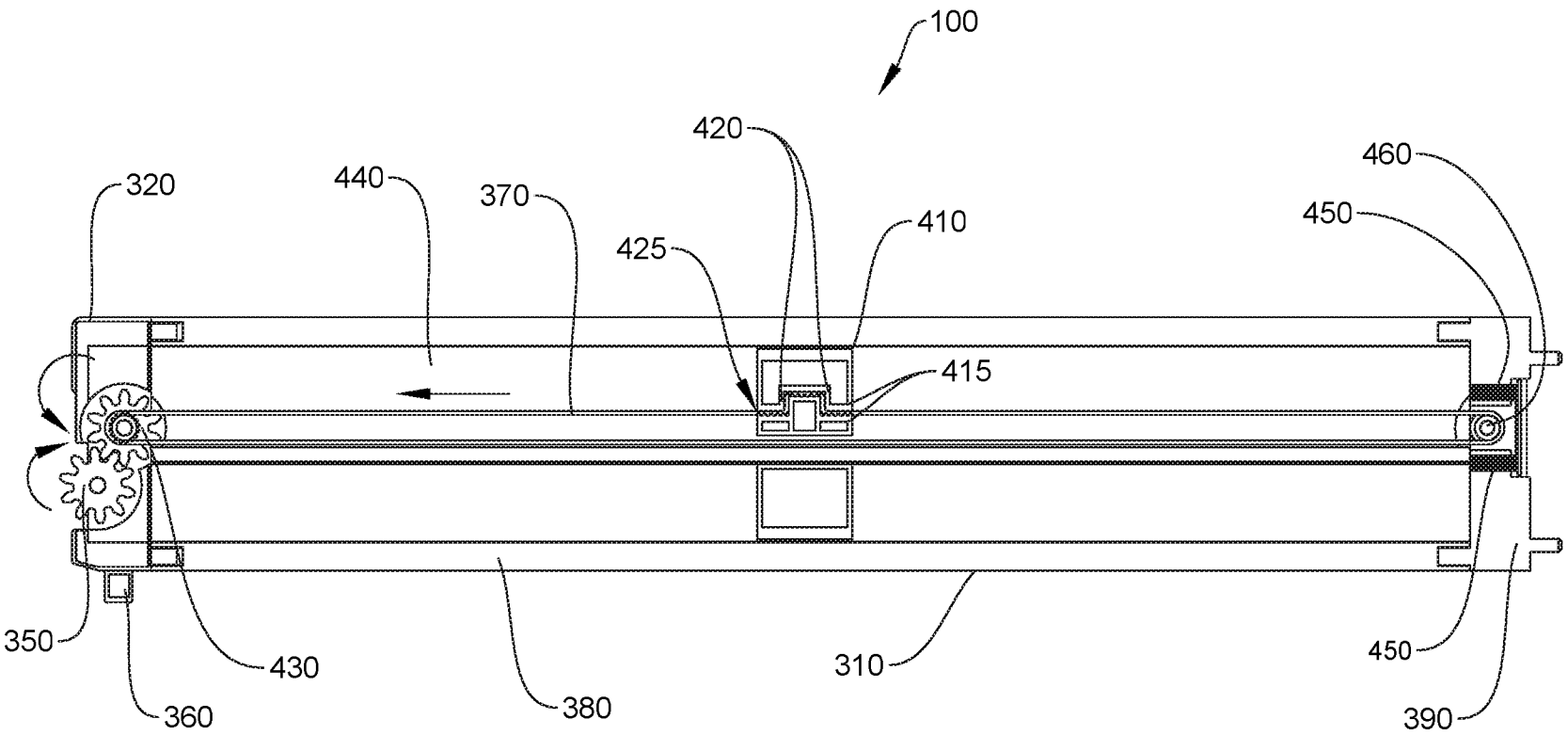
FIG. 4 is a side view depicting a partially disassembled embodiment of a dispenser of shelved products.

FIG. 4 is a side view depicting a partially disassembled embodiment of a dispenser of shelved products. In FIG. 4, pusher carriage 410 has been partially cut away to reveal a timing belt clamp 415 retaining timing belt 370 with two snap-in belt retainers 420. In an embodiment, timing belt clamp 415 is a solid part with belt retainers 420 being flexible enough to spread upon being forced to allow belt 370 to enter a retention groove 425 in pusher carriage 410 and then return to the original position to retain belt 370.

Front end 320 is shown to include a gear/pulley 430 that is driven by gear 350. Timing belt 370 engages the toothed pulley element of gear/pulley 430. Thus, gear/pulley 430 drives timing belt 370 according to the rotation of gear 350. When gear 350 is driven clockwise, gear/pulley 430 is driven counterclockwise, drawing pusher carriage 410 in a forward, dispensing direction 440. Belt tensioner 390 is partially cut away to reveal it is provided with an idler pulley 460, which engages timing belt 370. Timing belt 370 is tensioned using compression springs 450, which urge idler pulley 460 away from front end 320.

Figure 5:
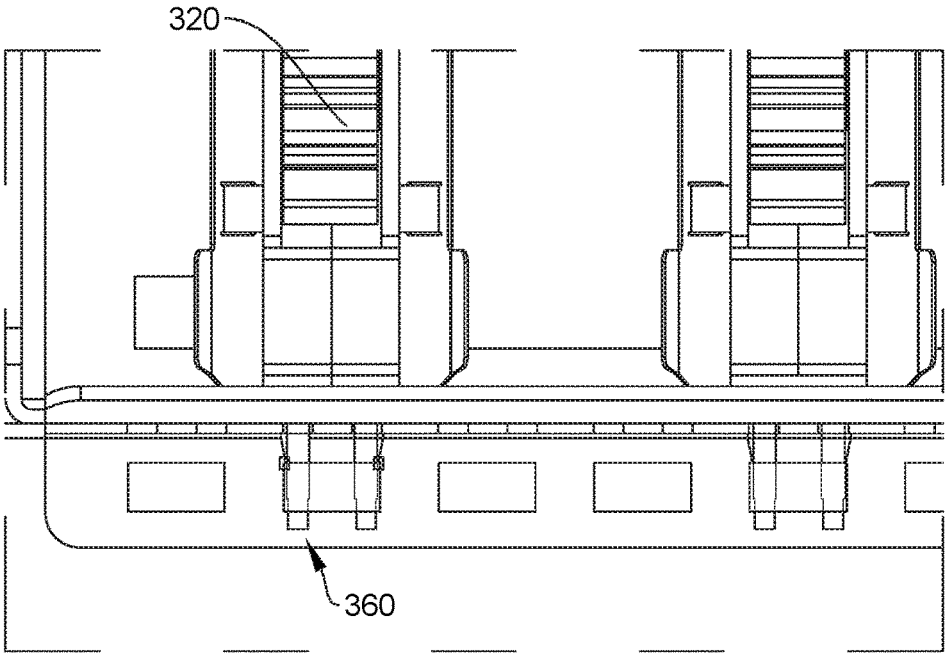
FIG. 5 is a partial front view depicting an embodiment of dispensers of shelved products attached to a vending machine.

FIG. 5 is a partial front view depicting an embodiment of dispensers of shelved products attached to a vending machine. In FIG. 5, front end 320 of dispenser 100 is shown equipped with latch pins 360 inserted into oval holes 210 for connecting dispenser 100 to a vending machine shelf.

Figure 6:
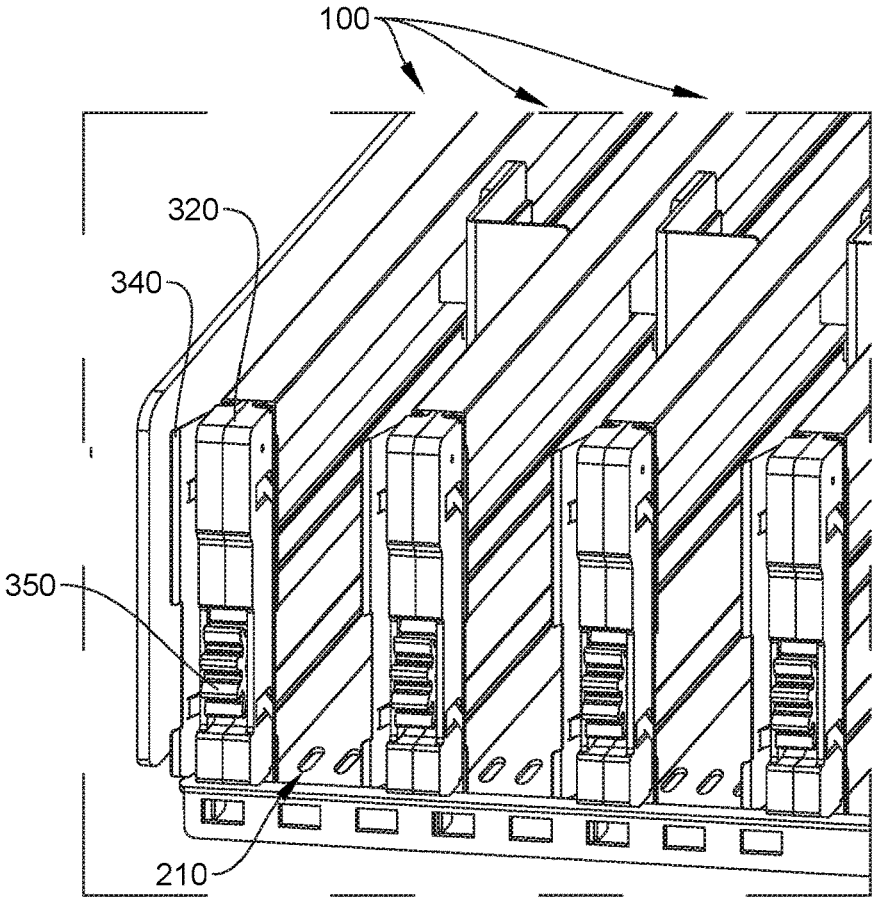
FIG. 6 is a partial perspective view depicting an embodiment of dispensers of shelved products attached to a vending machine.

FIG. 6 is a partial perspective view depicting an embodiment of dispensers 100 of shelved products attached to a vending machine and oval holes 210 for receiving latch pins 360.

Figure 7A:
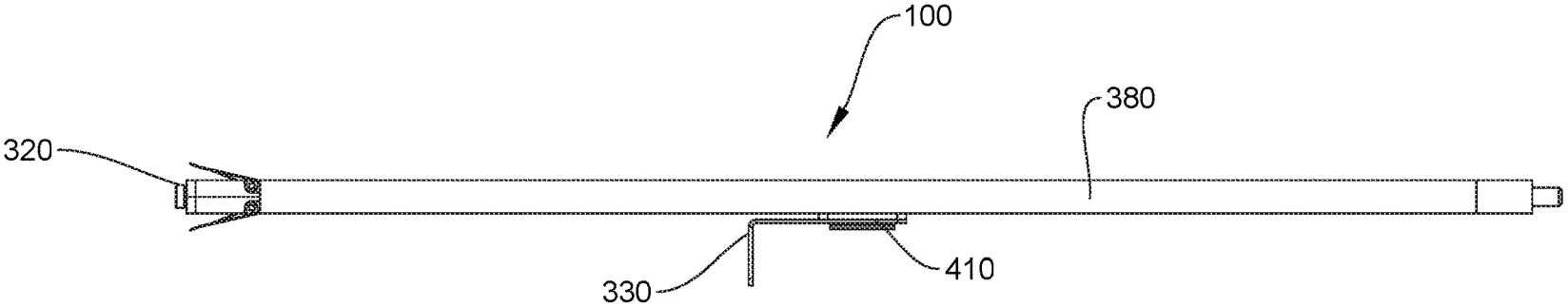
FIG. 7A is a top view of an embodiment of a dispenser of shelved products.

FIG. 7A is a top view of an embodiment of a dispenser of shelved products. In FIG. 7A, divider track 380 is shown to retain pusher carriage 410. Pusher carriage 410 in turn moves extender bracket 330 according to the motion of timing belt 370 (FIG. 3, 7B). Extender bracket 330 is shown to extend toward front end 320 from pusher carriage 410.

Figure 7B:
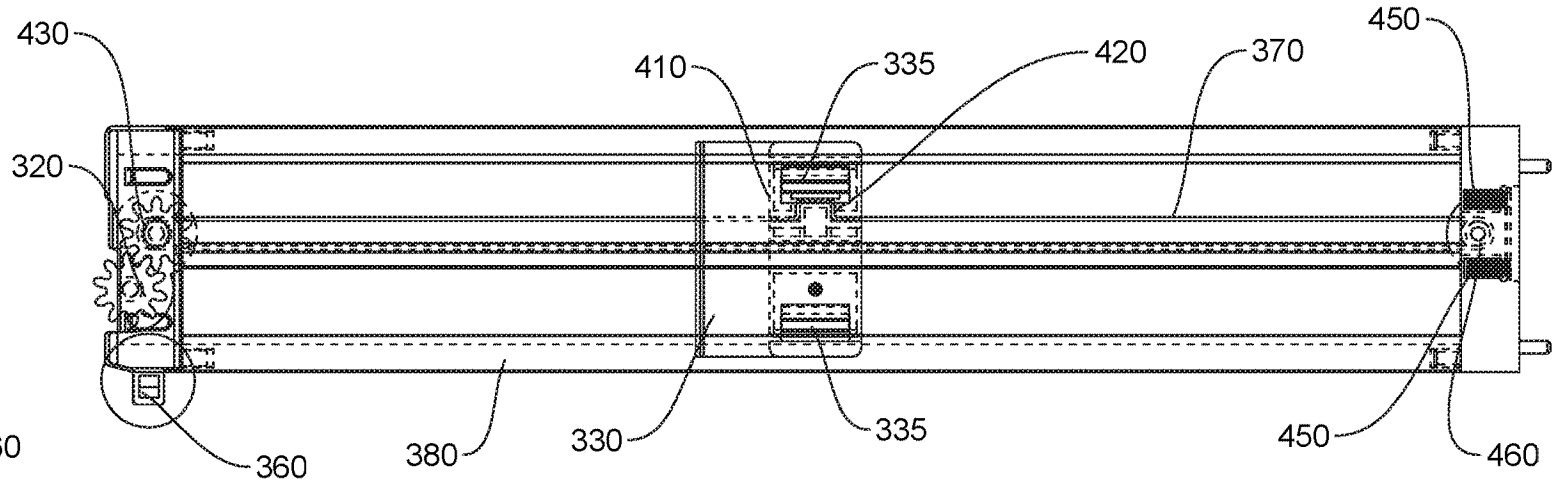
FIG. 7B is a side view of an embodiment of a dispenser of shelved products.

FIG. 7B is a side view of an embodiment of a dispenser of shelved products. In FIG. 7B, pusher carriage 410 is shown to be retained by and slide within divider track 380.

Figure 7C:
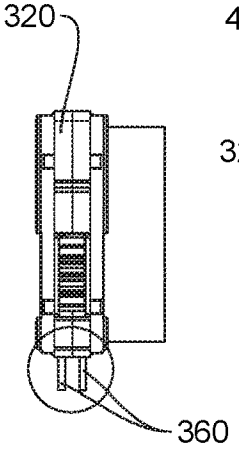
FIG. 7C is a front view of an embodiment of a dispenser of shelved products.

FIG. 7C is a front view of an embodiment of a dispenser of shelved products.

Figure 8:
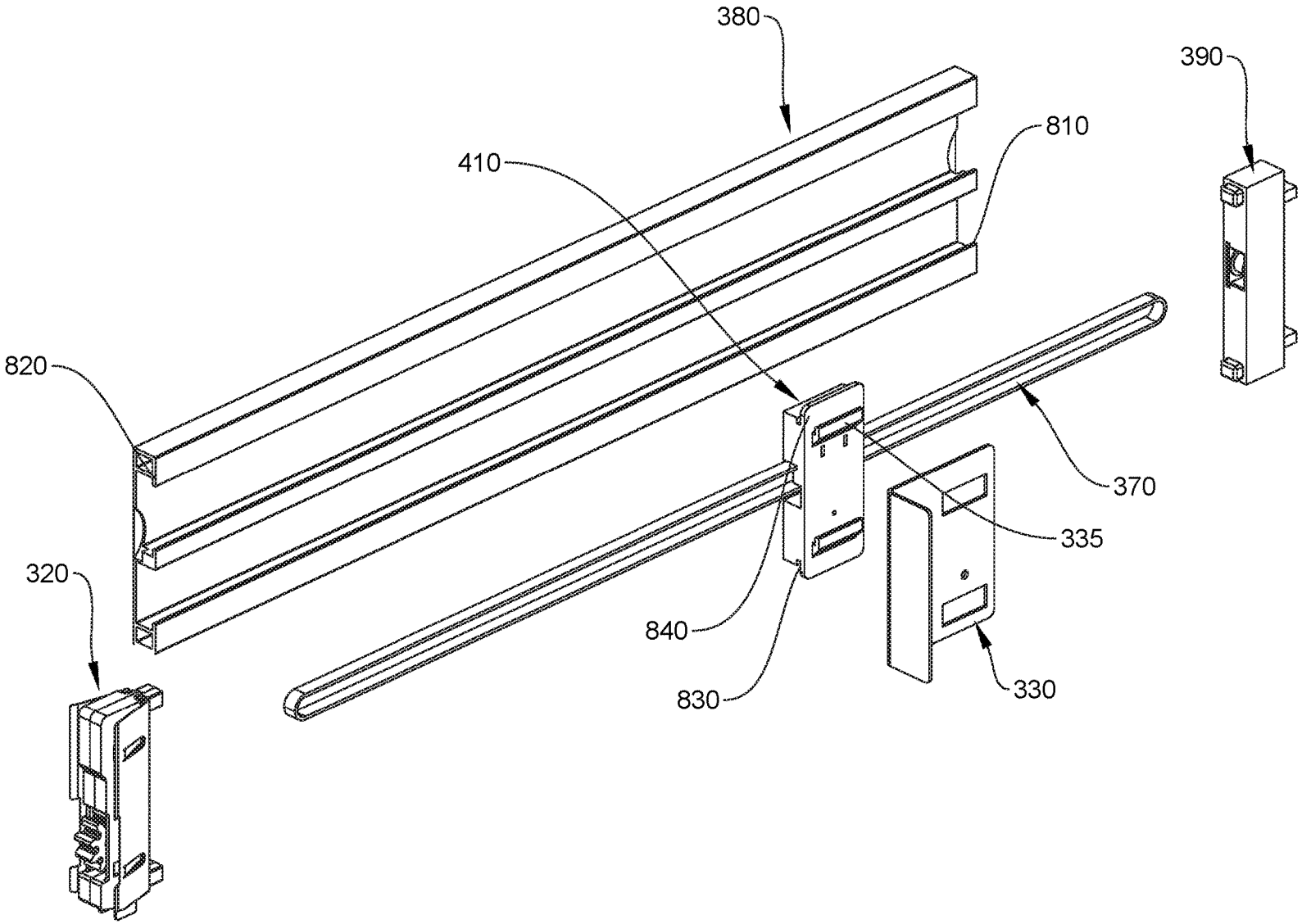
FIG. 8 is an expanded perspective view of an embodiment of a dispenser of shelved products.

FIG. 8 is an expanded perspective view of an embodiment of a dispenser of shelved products. In FIG. 8, divider track 380 is shown to be provided with rails 810 and 820 which cooperate with linear grooves 830 and 840 of pusher carriage 410. Pusher carriage 410 moves back and forth along divider track 380 guided by rails 810, 820.

Figure 9B:
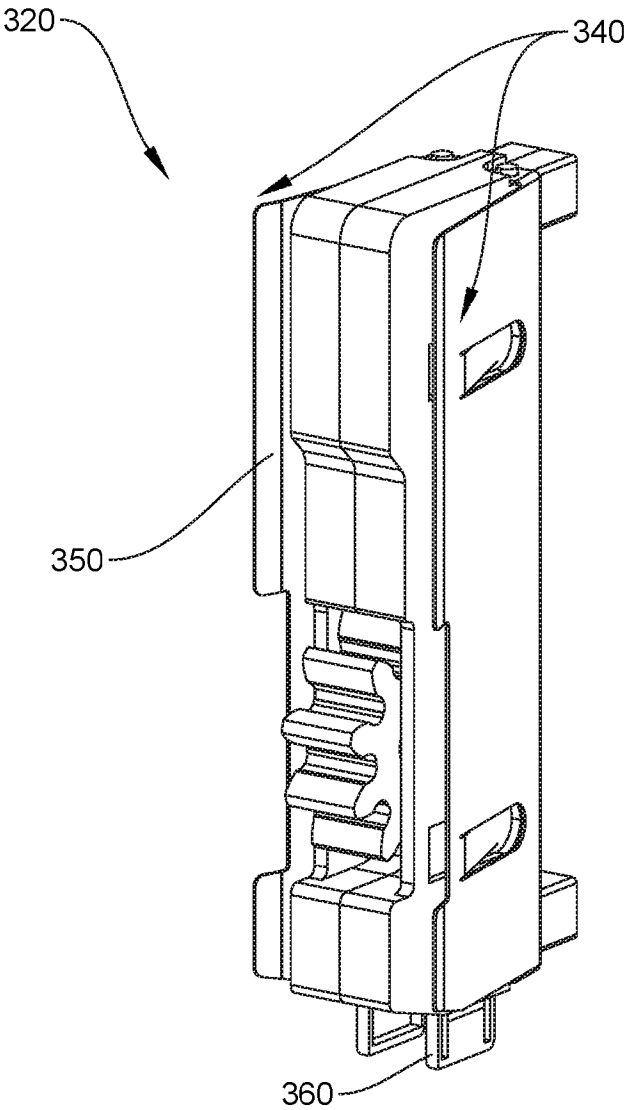
FIG. 9B is a perspective view of a divider front end of a dispenser of shelved products.
Figure 9A:
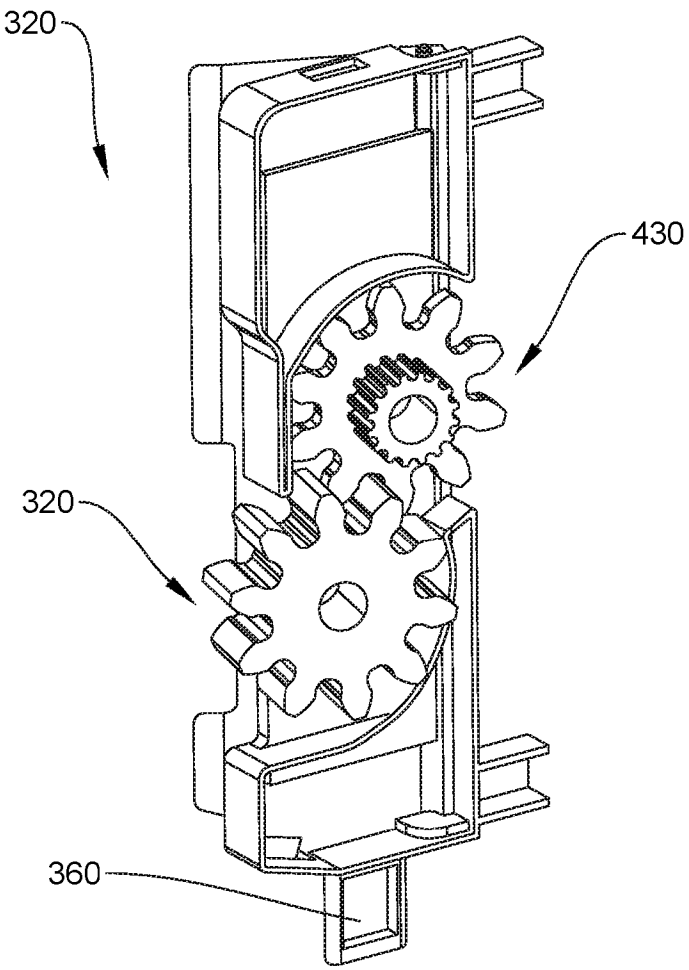
FIG. 9A is a partially disassembled perspective view of a divider front end of a dispenser of shelved products.

FIG. 9A is a partially disassembled perspective view of divider front end 320 of a dispenser of shelved products. FIG. 9A shows the relationship between gear 350 and gear/pulley 430 in more detail, gear 350 engaging the gear element of gear/pulley 430 and not engaging the toothed pulley element of gear/pulley 430.

FIG. 9B is a perspective view of divider front end 320 of a dispenser of shelved products. FIG. 9B shows flat spring retainers 340 in more detail.

Figure 10B:
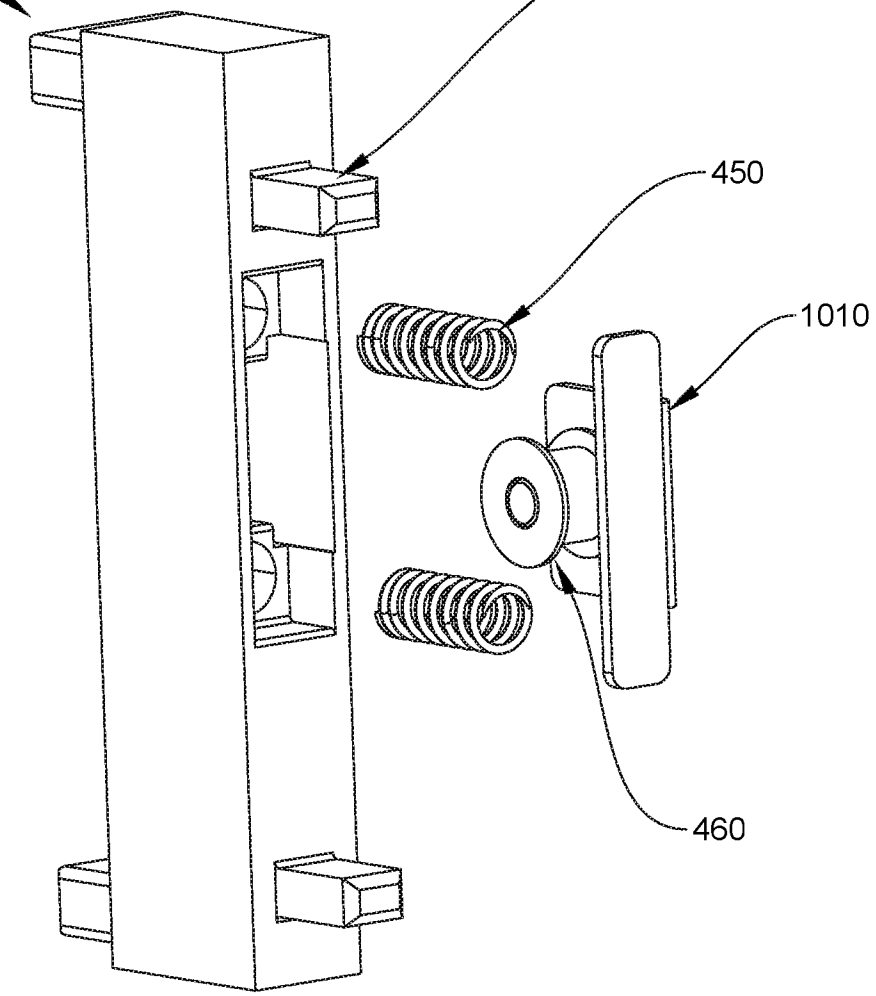
FIG. 10B is an expanded perspective view of a belt tensioner of a dispenser of shelved products.
Figure 10A:
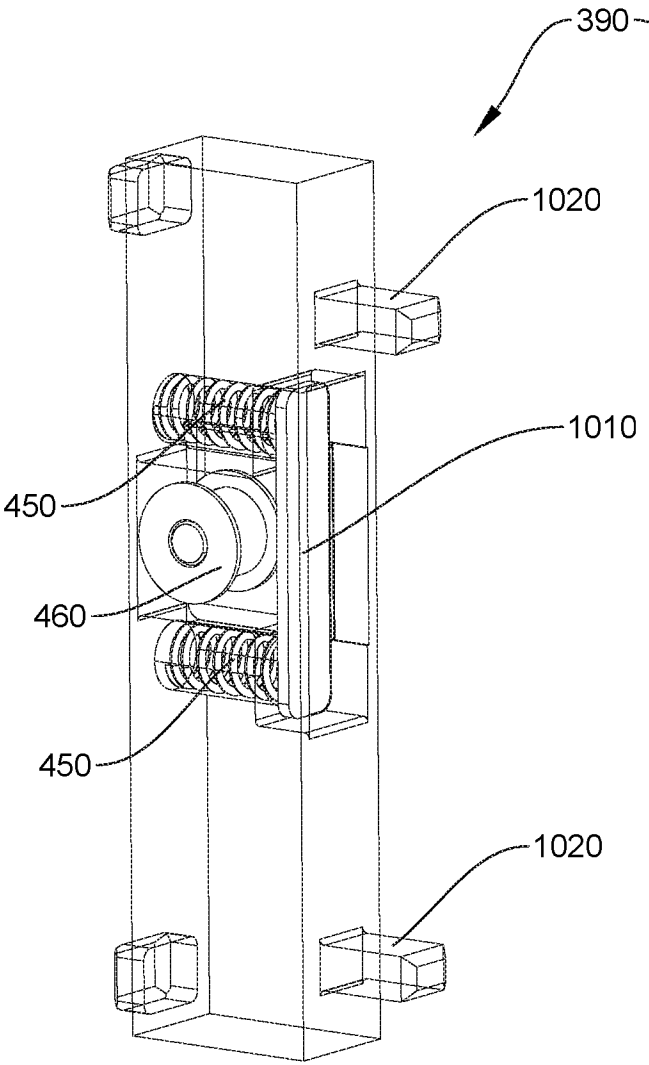
FIG. 10A is a transparent perspective view of a belt tensioner of a dispenser of shelved products.

FIG. 10A is a transparent perspective view of a belt tensioner of a dispenser of shelved products. In FIG. 10A, idler pulley 460 is shown to rotate about an axle of a slide bracket 1010. Timing belt 370 (not shown) runs about idler pulley 460. Slide bracket 1010 is urged by compression springs 450 away from front end 320, thereby providing tension to timing belt 370 (not shown).

FIG. 10B is an expanded perspective view of a belt tensioner of a dispenser of shelved products. Divider back pins 1020 engage back slots 215 (FIG. 2) to retain divider 100 on shelf 205.

Figure 11A:
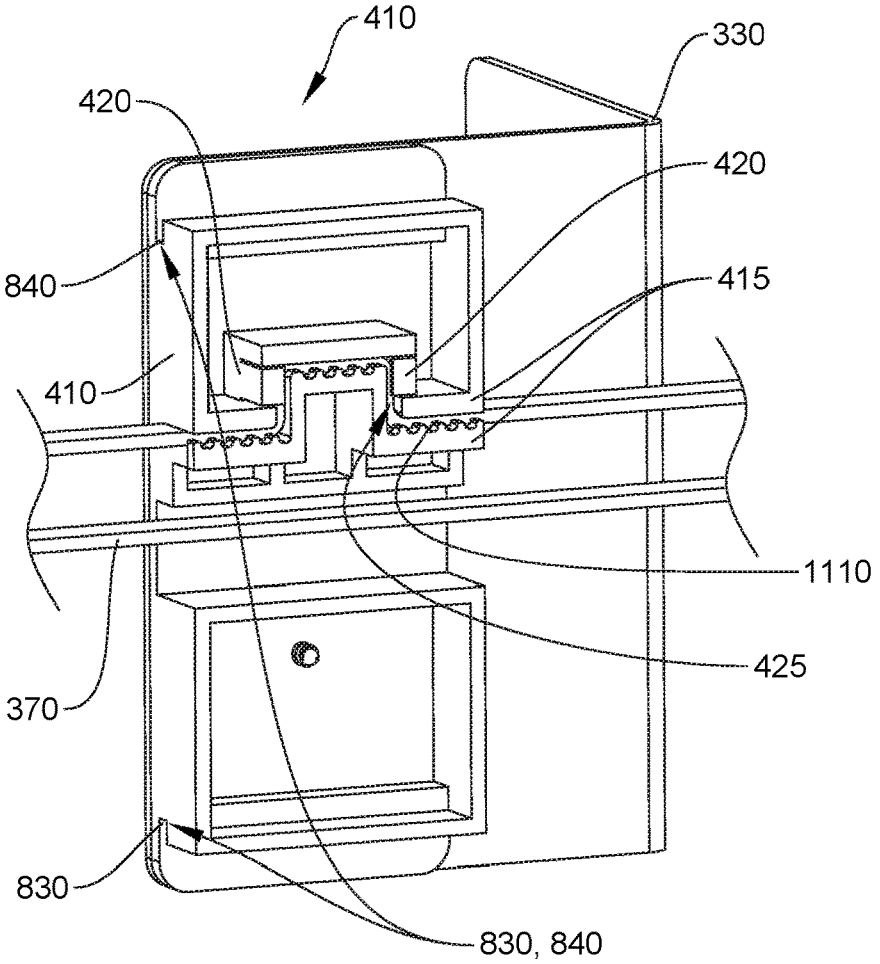
FIG. 11A is a perspective view of a timing belt clamp a dispenser of shelved products.

FIG. 11A is a perspective view of timing belt clamp 415 of a dispenser of shelved products. In FIG. 11A, pusher carriage 410 is shown with linear grooves 830, 840 which accept and are guided by rails 810, 820 of divider track 380. Pusher carriage 410 is further shown to include timing belt clamp 415, shown retaining timing belt 370 with belt retainers 420 and teeth 1110.

Figure 11B:
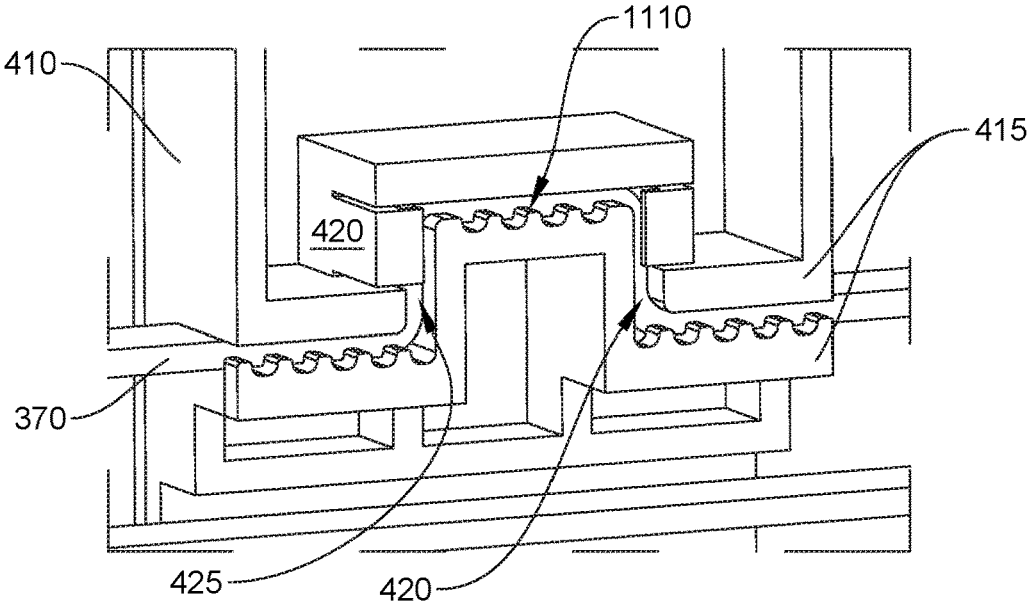
FIG. 11B is a perspective view of a detail of a timing belt clamp a dispenser of shelved products.

FIG. 11B is a perspective view of a detail of timing belt clamp 415 of a dispenser of shelved products. In FIG. 11B, snap-in belt retainers 420 are shown to be provided with teeth 1110 for retaining timing belt 370.

Figure 12:
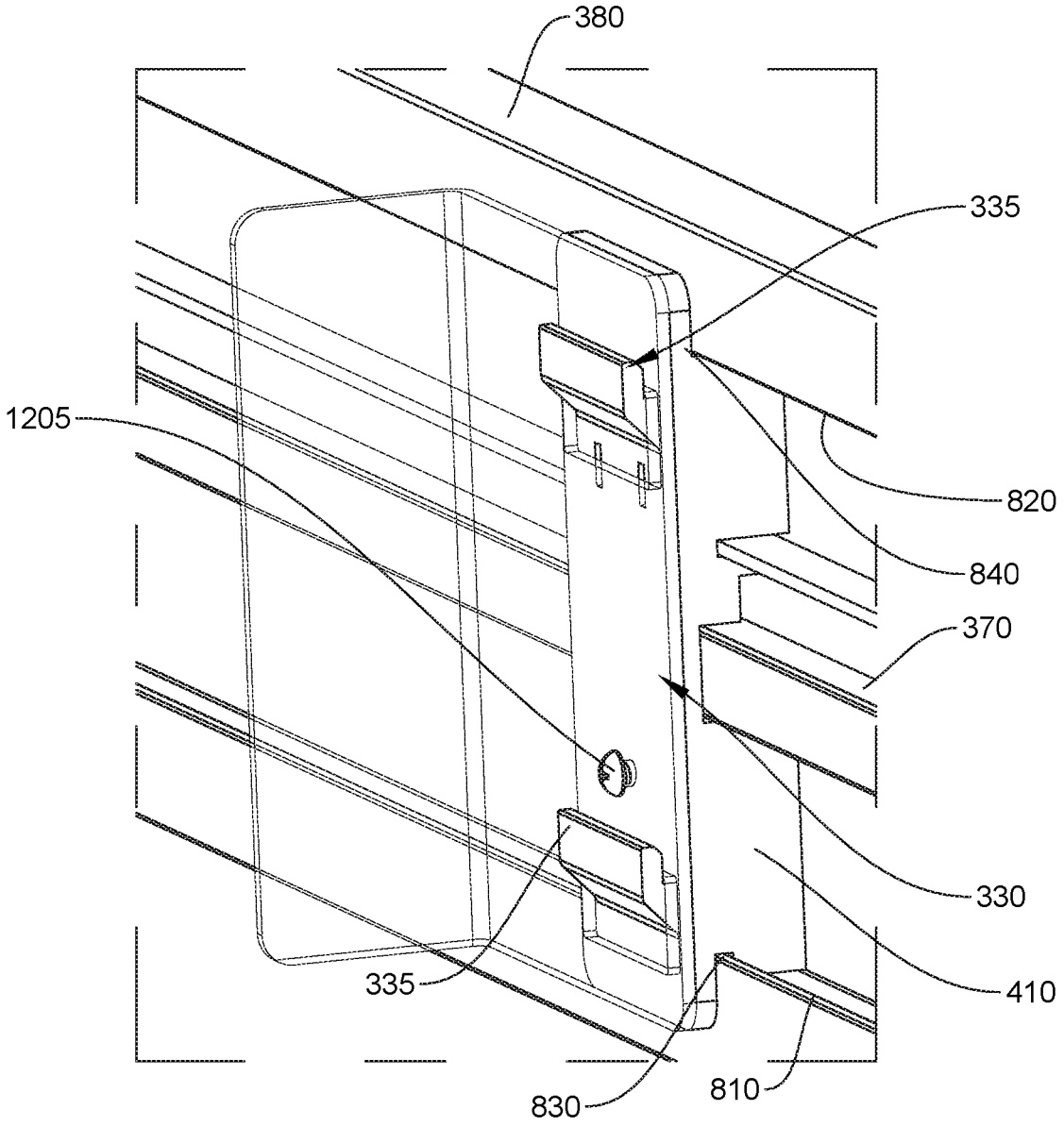
FIG. 12 is a transparent perspective view of an extender bracket of a dispenser of shelved products.

FIG. 12 is a partially transparent perspective view of an extender bracket of a dispenser of shelved products. In FIG. 12, pusher carriage 410 is shown to retain extender bracket 330 using bracket hooks 335 within slots of extender bracket 330. Extender bracket 330 is further retained using a screw 1205. Divider track 380 is shown to retain pusher carriage 410 between rails 810, 820. Pusher carriage 410 is guided by grooves 830, 840 along rails 810, 820 in the direction of travel of timing belt 370.

Figure 13:
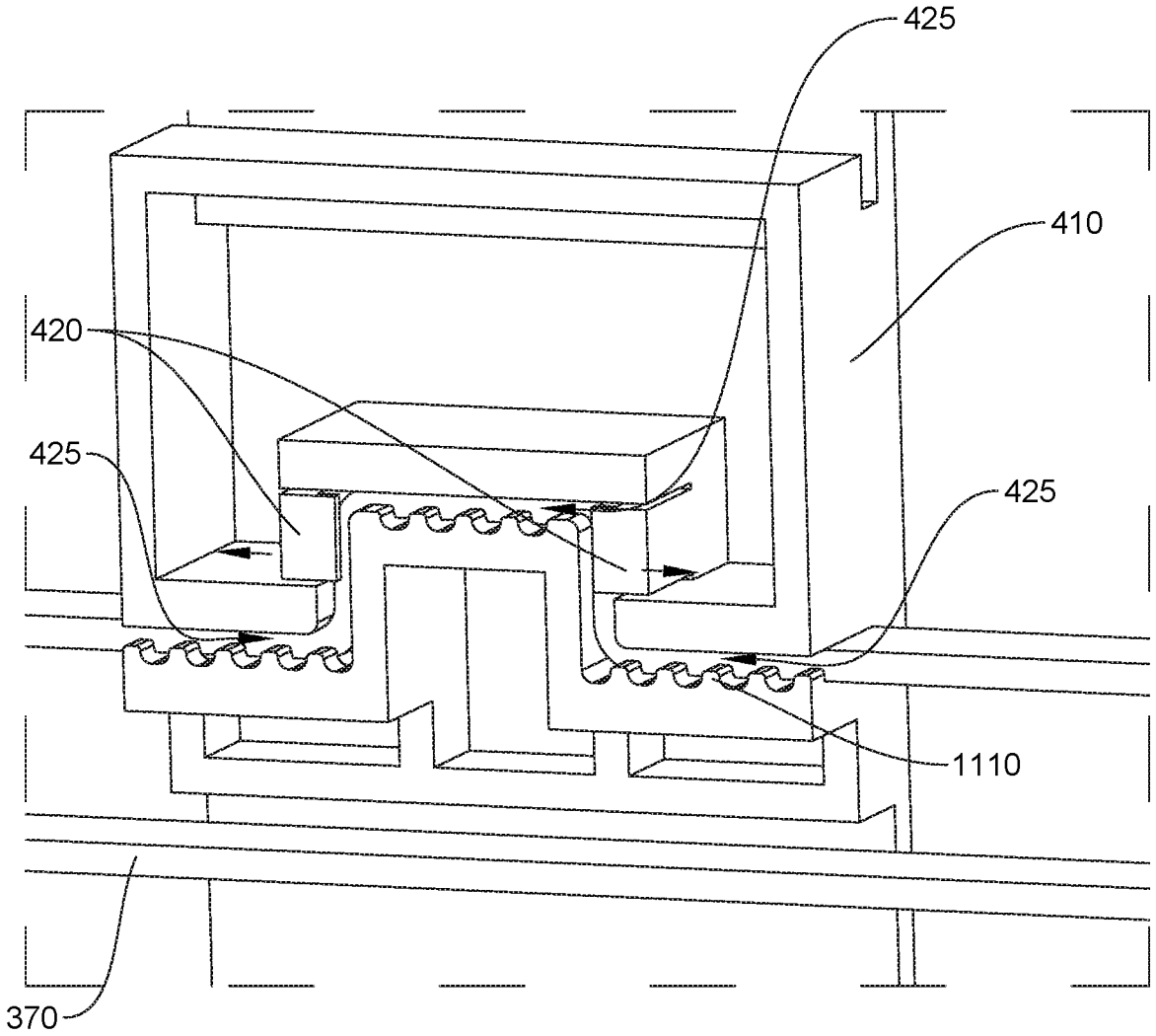
FIG. 13 is a perspective view depicting a timing belt clamp of an embodiment of a dispenser of shelved products.

FIG. 13 is a perspective view depicting timing belt clamp 415 of an embodiment of a dispenser of shelved products. In FIG. 13, pusher carriage 410 is shown with belt 370 retained by belt retainers 420. The arrows indicate the direction that belt retainers 420 may flex to allow belt 370 to enter retention groove 425.

Figure 14:
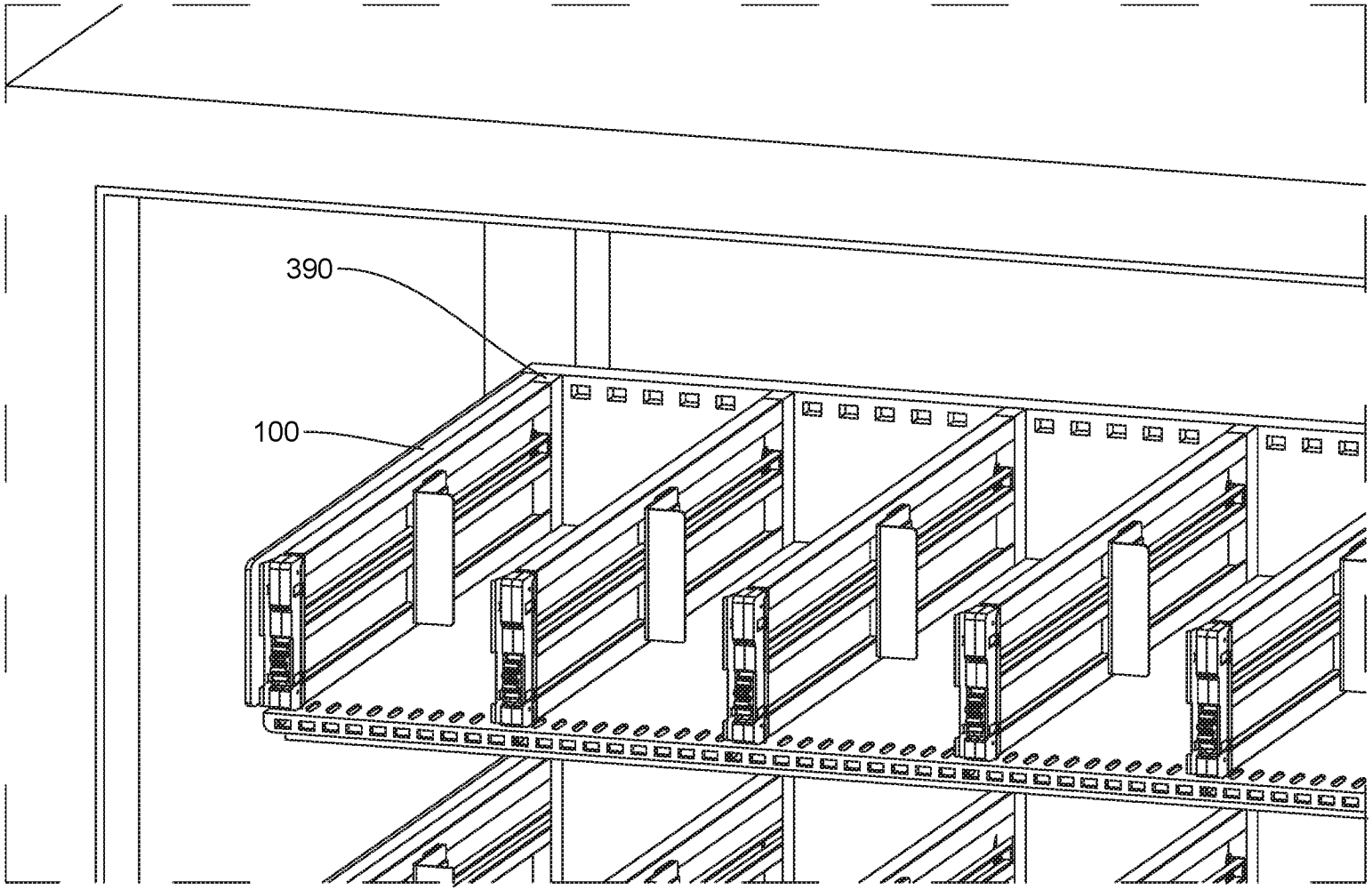
FIG. 14 is a perspective view further illustrating aspects of an embodiment of a dispenser of shelved products.

FIG. 14 is a perspective view further illustrating aspects of an embodiment of a dispenser of shelved products. In FIG. 14, the front arrow indicates optional holes in the shelf for receiving latch pins 360. Similarly, the rear arrow indicates optional holes in the shelf for receiving the pins from belt tensioner 390.

Figure 15:
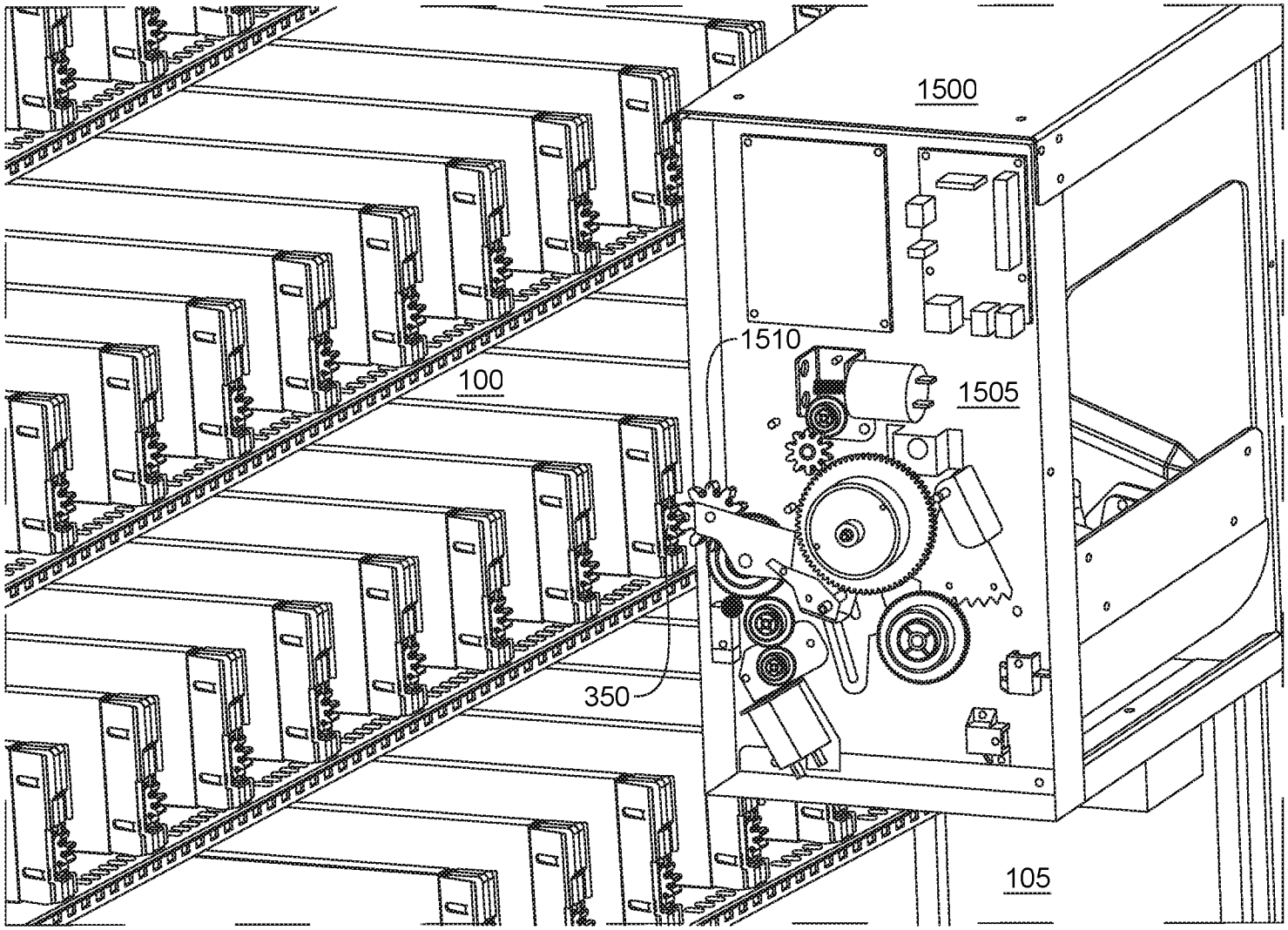
FIG. 15 is a partially transparent perspective view depicting a mechanism for driving an embodiment of a dispenser of shelved products.

FIG. 15 is a partially transparent perspective view depicting a mechanism for driving an embodiment of a dispenser 100 of shelved products. In FIG. 15, vending machine 105 is equipped with a belt conveyor bucket 1500. Belt conveyor bucket 1500 includes a pusher drive gear mechanism 1505 with a gear drive 1510. Belt conveyor bucket 1500 has been positioned so that pusher drive gear mechanism 1505 engages drive gear 350 with gear drive 1510. Belt conveyor bucket 1500 may be positioned by vending machine 105 in both X and Y directions to engage each dispenser and drive that dispenser's drive gear to dispense product, with controller 120 directing the positioning using information of the positions of each dispenser from a database. Conveyor bucket 1500 then receives the product and delivers the product to vending machine dispensing door 110. Conveyor bucket 1500 is exemplary of an apparatus that may be used to drive the dispenser's drive gear and receive the dispensed product. In an embodiment, a conveyor platform may be equipped with a drive gear to drive the dispenser's drive gear and receive the dispensed product. In an embodiment, a robotic arm may be equipped with a drive gear to drive the dispenser's drive gear and receive the dispensed product. Thus, the conveyor bucket 1500, the conveyor platform, and the robotic arm are examples of a moveable platform (or "fetch mechanism") that engage the dispenser, receive product from the dispenser, and deliver the product to the dispensing door.

Figure 16:
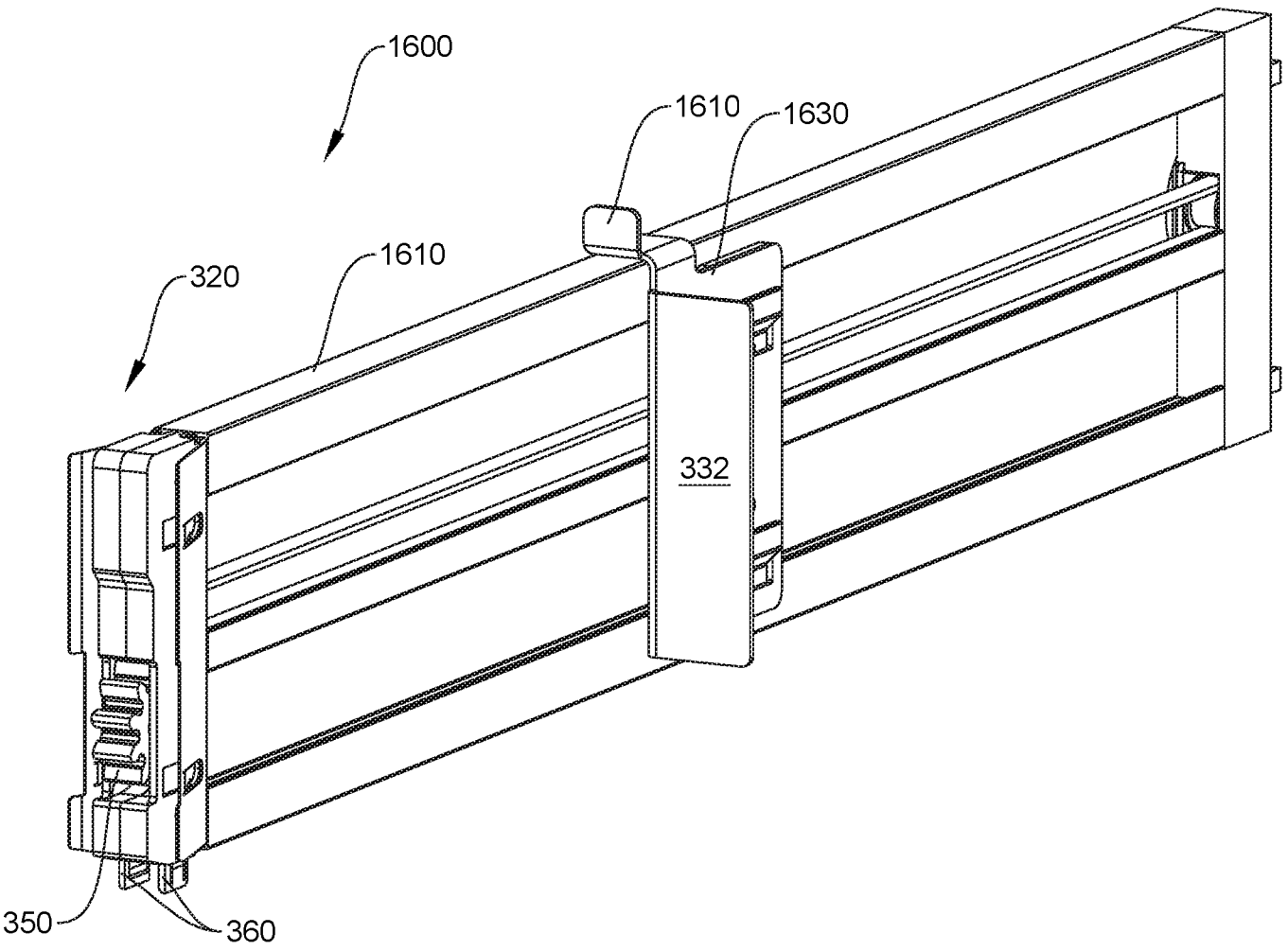
FIG. 16 is a perspective view depicting an embodiment of a divider 1600 for dispensing shelved products.

FIG. 16 is a perspective view depicting an embodiment of a dispenser 1600 of shelved products. The description of FIG. 16 incorporates the description of FIG. 3, with FIG. 16 further showing modifications to the extender bracket 330 of FIG. 3. In FIG. 16, extender bracket 1630 includes a tab 1610 (or "flag") that moves along the top of divider 310 with the motion of extender bracket 1630. In the embodiment, tab 1610 is an obstacle for non-contact range detection. A corresponding non-contact range sensor (e.g., sensor 1910, FIG. 19) is incorporated into conveyer bucket 1900 (FIG. 19) to determine the distance of tab 1610, and therefore also extender bracket 1630, from conveyer bucket 1900. Various embodiments may employ different range sensors, e.g., ultrasound, IR, or laser distance sensors. An exemplary ultrasound sensor emits an ultrasound at 40,000 Hz. This ultrasound travels through the air and if there is an object or obstacle on its path, it will bounce back to the emitting module. The module calculates the distance from the travel time and the speed of sound. An exemplary IR distance sensor takes a continuous distance reading and reports the distance as an analog voltage with a distance range of 20 cm (~8") to 150 cm (~60"). And an exemplary short-range and high-precision laser distance sensor measures to within 8 micrometers resolution using CMOS technology, while an exemplary long-range laser distance sensor uses the time of flight (measuring transit time of the reflected light) to measure distances up to 100 meters. Such laser sensors may employ class 1 or 2 lasers, with such DC-powered units supporting analog outputs of 4-20 mA or 0-10 VDC.

In an embodiment, sensor 1910 may be a laser range-finding sensor positioned above drive gear 1510. Sensor 1910 directs the laser down dispenser 1600 and receives a signal that measures the distance from the laser to tab 1610. Tab 1610, positioned above divider 310 of dispenser 1600 and connected to carriage 1630, sits at or near the back of the product, and so provides the distance from chassis 1900 to the furthest back product. With information regarding the size of the relevant product, controller 120 may determine the number of products on the shelf, e.g., if a 92 mm depth is detected and each product is 18 mm deep, there are 5 products on the shelf.

In the embodiment of FIG. 16, tab 1610 and the associated range sensor provide the ability to measure the distance from conveyor bucket 1900 to extender bracket 1630. In turn, having position data for tab 1610 on divider 310 allows controller 120 of vending machine 105 to calculate the number of products remaining to be dispensed by divider 310 within that division of the shelf—based on the knowledge provided to controller 120 of the length of products stored on that division of the shelf and under control of dispenser 1600. Thus, using information regarding the dimensions of products stored for dispensing by a particular dispenser (from, e.g., a database stored on the vending machine, or accessible by the vending machine via a network), the embodiment provides for controller 120 taking an inventory of the number of products remaining for that dispenser. By controller 120 moving the conveyor bucket in the X-direction to each dispenser on a shelf, the shelf may be inventoried. By controller 120 moving the conveyor along X and Y directions to each dispenser on each shelf, the vending machine may be inventoried.

In an embodiment, the database referenced to perform an inventory may include the superset of products that can be sold in the machine along with the dimensions of each product. The database may further include a planogram for the vending machine of interest where the planogram stores the descriptions (e.g., dimensions) of the specific products in the vending machine along with each product's orientation with respect to the shelf (or dispenser). The planogram further discloses what product is dispensed by a particular dispenser. Such information may be stored as a dispenser X/Y position in the vending machine, the dispenser being given a unique designation, and the product being listed as stored with that dispenser (e.g., Dispenser N is at location X=0.5 m, Y=0.1 m and Dispenser N contains Product M).

In an embodiment, the vending machine may be programmed to automatically count inventory in the machine when desired or scheduled by positioning the conveyor bucket at each shelf, and dispenser on that shelf, and reading the distance from the tag to the conveyor bucket using the range sensor. With the distance known, vending machine software then subtracts the distance from the sensor position to the front of the shelf (a known quantity) and then divides the remaining distance by the depth of the product associated with that dispenser position. The result yields the number of products at that shelf/dispenser position. In an embodiment, the conveyor bucket may also engage the pusher to ensure that all items at that shelf/dispenser position are moved to the front of the shelf before measuring. This embodiment may include equipping the conveyor bucket with a sensor to determine when product is at the front of the shelf. Once a particular shelf/dispenser position has been measured, the conveyor bucket is repositioned to a new shelf/dispenser position and the process repeated until all shelf/dispenser positions have been evaluated.

Figure 17:
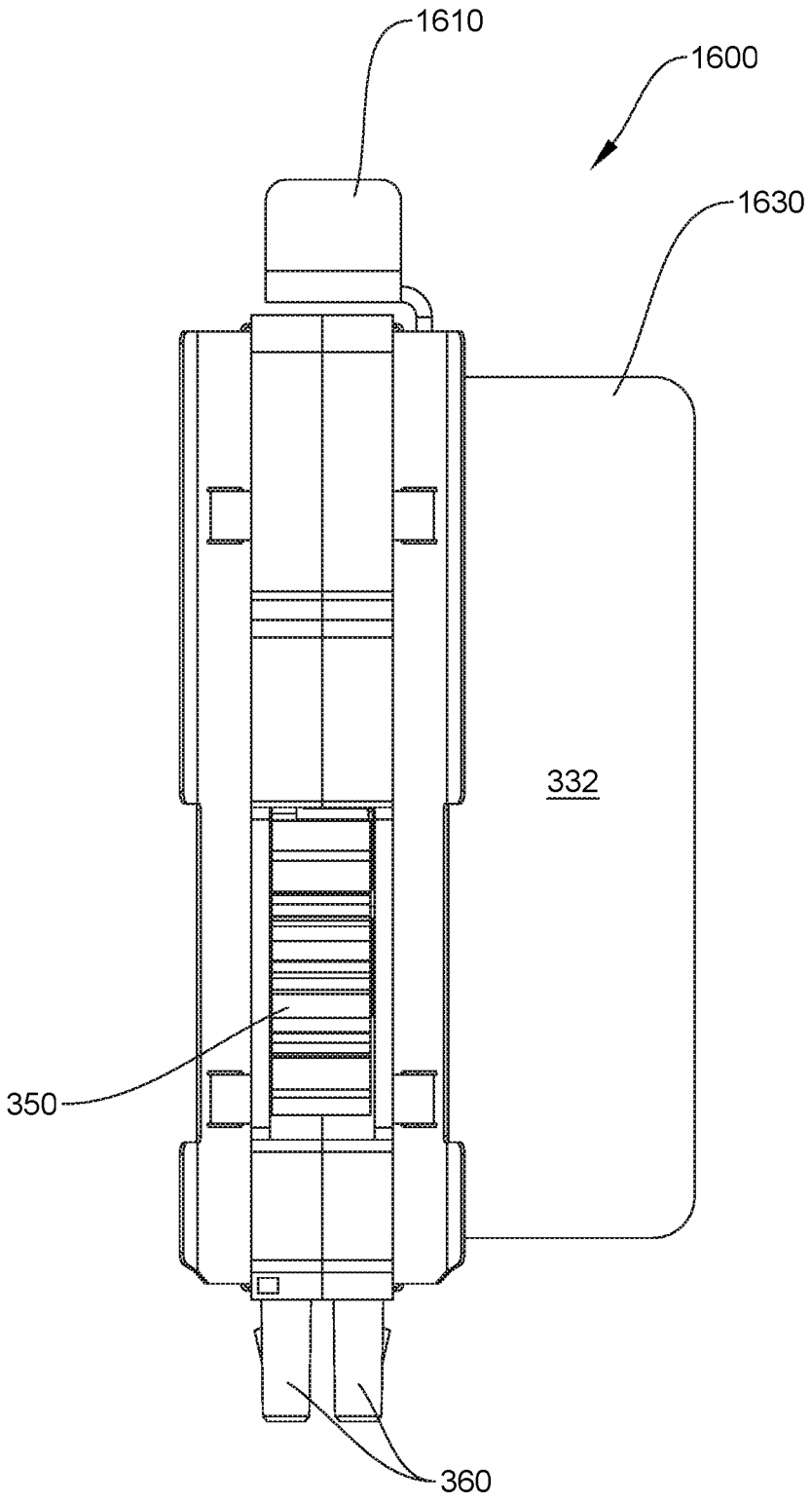
FIG. 17 is a front view depicting an embodiment of a dispenser of shelved products.

FIG. 17 is a front view depicting dispenser 1600 of shelved products. In FIG. 17, tab 1610 is shown to be above divider 310 in an area that is likely to be visible to sensor 1910 (FIG. 19) and unlikely to be obscured by product.

Figure 18:
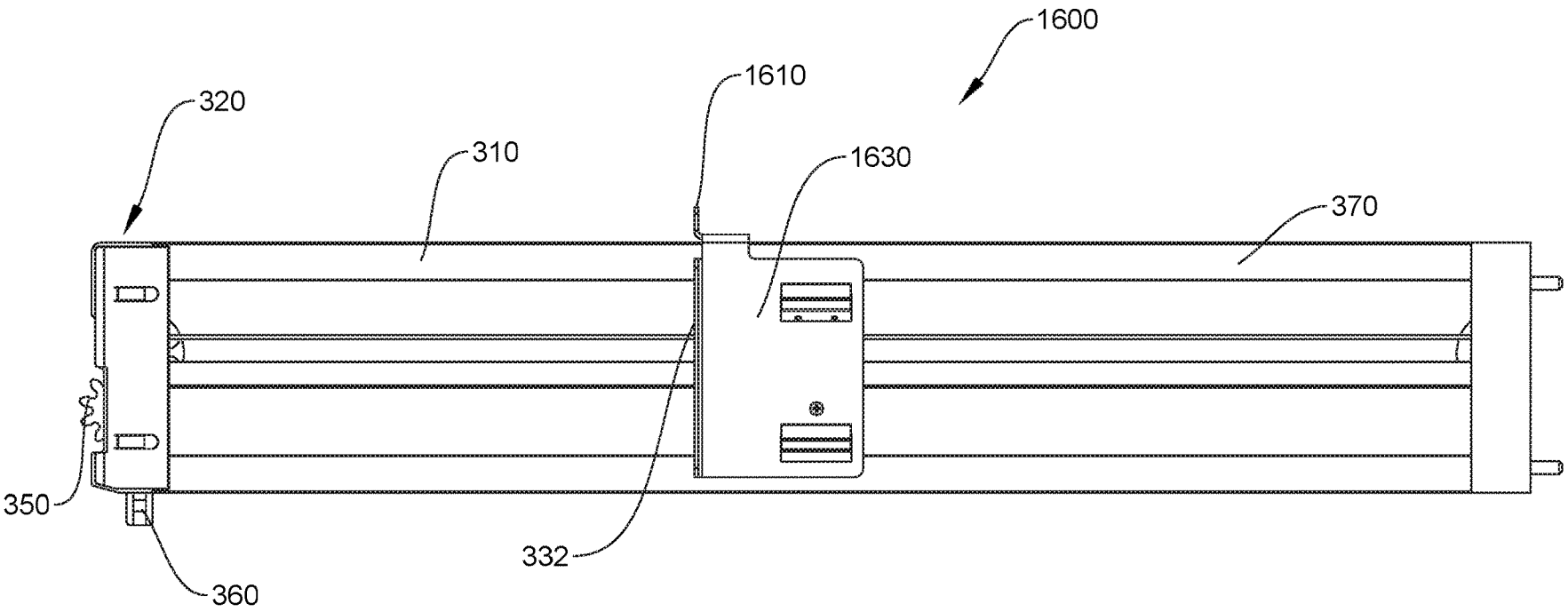
FIG. 18 is a side view depicting an embodiment of a dispenser of shelved products.

FIG. 18 is a side view depicting dispenser 1600 of shelved products. In FIG. 18, tab 1610 is shown to be the same distance as extender face 332 from front end 320.

Figure 19:
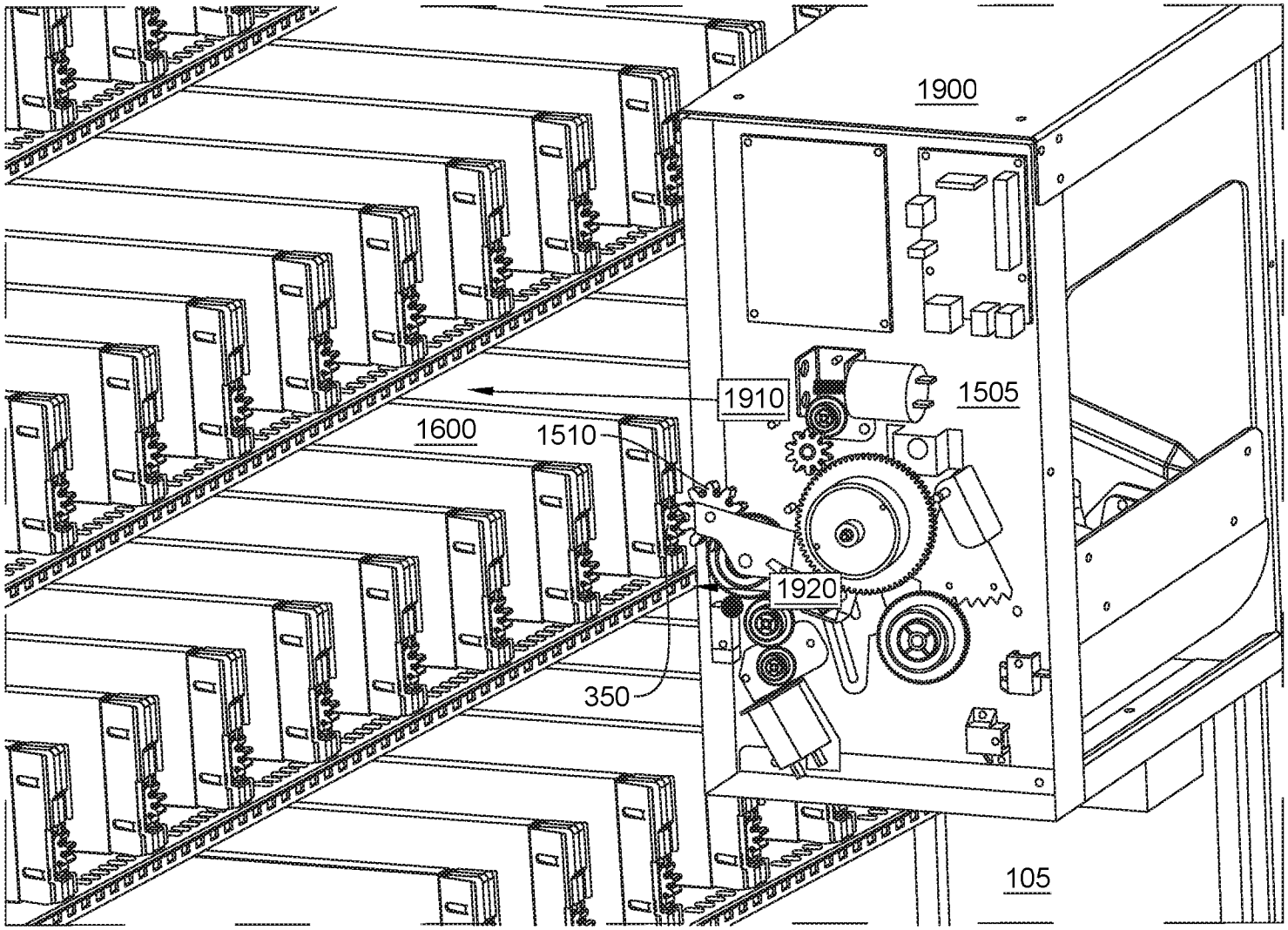
FIG. 19 is a partially transparent perspective view depicting a mechanism for driving an embodiment of a dispenser of shelved products.

FIG. 19 is a partially transparent perspective view depicting a mechanism for driving an embodiment of a dispenser of shelved products. The description of FIG. 19 incorporates the description of FIG. 15, with FIG. 19 further showing modifications to the conveyor bucket 1600 of FIG. 15. In FIG. 19, a conveyor bucket 1900 includes a first range sensor 1910 and a second range sensor 1920. Range sensor 1910, as described with respect to FIG. 16, is used to measure the distance from conveyor bucket 1900 to a tab 1610 (not shown in FIG. 19) on extender bracket 1630 of dispenser 1600. The measured distance is illustrated by the arrow extending from sensor 1910. The distance measured by sensor 1910 is then used to calculate a number of remaining products within the row defined by dispenser 1600. In an embodiment, range sensor 1920 is used to detect the location of a dispenser along a row by detecting the presence of latch pins 360 through slots in the shelf. When a dispenser is fixed to the shelf, latch pins 360 extend through and below the shelf. For example, in FIG. 19, the slot in each shelf below a dispenser is darkened, which indicates that the latch pins for that dispenser are located behind that slot. Thus, when range sensor 1920 is directed at a slot, the distance registered by the sensor will determine whether or not a dispenser is located above the slot.

In an embodiment, latch pins 360 are made of plastic and, during manufacture, an IR-reflecting ink may be injected into the plastic resulting in the latch pins 360 glowing (or otherwise reflecting IR light more efficiently) when hit with IR light. Such glowing latch pins are more easily detected by IR range sensors.

In an embodiment, the positions of the shelves and the dispensers within a vending machine may be automatically detected by conveyor bucket 1900. In the embodiment, shelves are placed along the Y axis and dispensers are placed along the X axis of each shelf. Conveyor bucket 1900 may then be moved vertically by vending machine 105 with sensor 1910 or sensor 1920 or both registering the location of each shelf by detecting the reduction in the distance sensed. The location of each shelf is then stored with respect to the vertical movement of conveyor bucket 1900. Subsequently, conveyor bucket 1900 may be positioned to align sensor 1920 with the slots of a particular shelf. Conveyor bucket 1900 may then be moved horizontally by vending machine 105 with sensor 1920 registering the location of each dispenser by detecting latch pins 360 through a slot—as determined by a reduction in the distance sensed compared to the distance sensed when a slot is "empty." Sensor 1910 may also be used to register the location of each dispenser by detecting tab 1610 above each dispenser 1600. The location of each dispenser along the shelf is then stored with respect to the horizontal movement of conveyor bucket 1900. The automatic detection of shelf positions and associated dispenser locations provides the vending machine to also calculate the number of product positions (or "SKU" positions) in that vending machine. When combined with information regarding what particular product is contained by each product position, the vending machine may use that information to create a catalog of what it contains. That catalog may also be known as a "planogram" for that location. With this catalog, when a particular item is selected by a consumer using, e.g., a vending machine's touchscreen or other input apparatus, the vending machine may locate that product using the catalog and direct the conveyor bucket to that shelf/row location and to dispense the product.

In an embodiment, a magnet may be affixed to the front of dispenser 1600, e.g., below drive gear 350, with a corresponding magnetic sensor added to 1900, e.g., near the position of sensor 1920. Information from the magnetic sensor may then allow controller 120 to determine the location of dispenser 1600, both horizontally and vertically.

In an embodiment of a dispenser, belt 370, gear/pulley 320, and idler pulley 460 may be replaced by a threaded shaft-drive arrangement. The threaded shaft would replace belt 370 and run along divider 310 much like belt 370. The threaded shaft would engage a corresponding threaded section of carriage 410, causing carriage 410 to move forward or backward along the shaft depending on the rotation of the shaft. The rotation of the shaft would be caused by a bevel gear arrangement converting rotation about the axis of drive gear 350 into rotation of the shaft. Thus, the belt 370 and the drive shaft are used in different embodiments of a linear positioner for positioning carriage 410 along divider 310.

Figure 20:
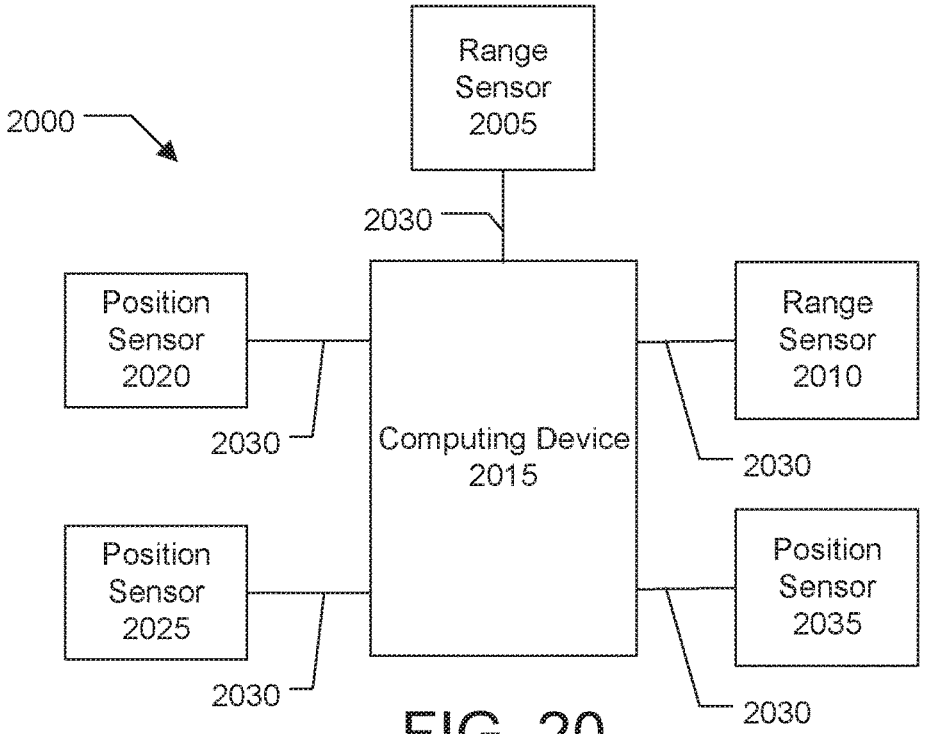
FIG. 20 is a simplified, exemplary block diagram of an embodiment of a system for controlling a dispenser of shelved products.

FIG. 20 is a simplified, exemplary block diagram of an embodiment of a system 2000 for implementing the embodiments of systems and methods disclosed herein. System 2000 may include a number of sensors, e.g., a tab range sensor 2005 (e.g., sensor 1910 as described within this disclosure), a dispenser position sensor 2010 (e.g., range sensor 1920, as described within this disclosure), a magnetic dispenser position sensor 2020, a bucket X-position sensor 2025, and a bucket Y-position sensor 2035, for developing data regarding the position of a tab, a position of a dispenser, or a position of a conveyor bucket. Sensors 2005, 2010, 2020, 2025, and 2035 are in communication with a computing device 2015, e.g., controller 120. Computing device 2015 may further be in control of bucket 1500, 1900, and dispensing door 110. Computing device 2015 may receive input from interface 115 and display information on interface 115. Sensors 2005, 2010, 2020, 2025, and 2035 may supply data to computing device 2015 via communication links 2030.

Computing device 2015 may include a user interface (e.g., interface 115) and software, which may implement the steps of the methods disclosed within. Computing device 2015 may receive data from sensors 2005, 2010, 2020, 2025, and 2035, via communication links 2030, which may be hardwire links, optical links, satellite or other wireless communications links, wave propagation links, or any other mechanisms for communication of information. Various communication protocols may be used to facilitate communication between the various components shown in FIG. 20. Distributed system 2000 in FIG. 20 is merely illustrative of an embodiment and does not limit the scope of the systems and methods as recited in the claims. In an embodiment, the elements of system 2000 are incorporated into a vending machine (e.g., vending machine 100). One of ordinary skill in the art would recognize other variations, modifications, and alternatives. For example, more than one computing device 2015 may be employed. As another example, sensors 2005, 2010, 2020, 2025, and 2035 may be coupled to computing device 2015 via a communication network (not shown) or via some other server system.

Computing device 2015 may be responsible for receiving data from sensors 2005, 2010, 2020, 2025, and 2035, performing processing required to implement the steps of the methods, and for interfacing with the user. In some embodiments, computing device 2015 may receive processed data from sensors 2005, 2010, 2020, 2025, and 2035. In some embodiments, the processing required is performed by computing device 2015. In such embodiments, computing device 2015 runs an application for receiving user data, performing the steps of the method, and interacting with the user. In other embodiments, computing device 2015 may be in communication with a server, which performs the required processing, with computing device 2015 being an intermediary in communications between the user and the processing server.

System 2000 may enable users to access and query information developed by the disclosed methods. Some example computing devices 2015 include devices running the Apple iOS®, Android® OS, Google Chrome® OS, Symbian OS®, Windows Mobile® OS, Windows Phone, BlackBerry® OS, Embedded Linux, Tizen, Sailfish, webOS, Palm OS® or Palm Web OS®.

Figure 21:
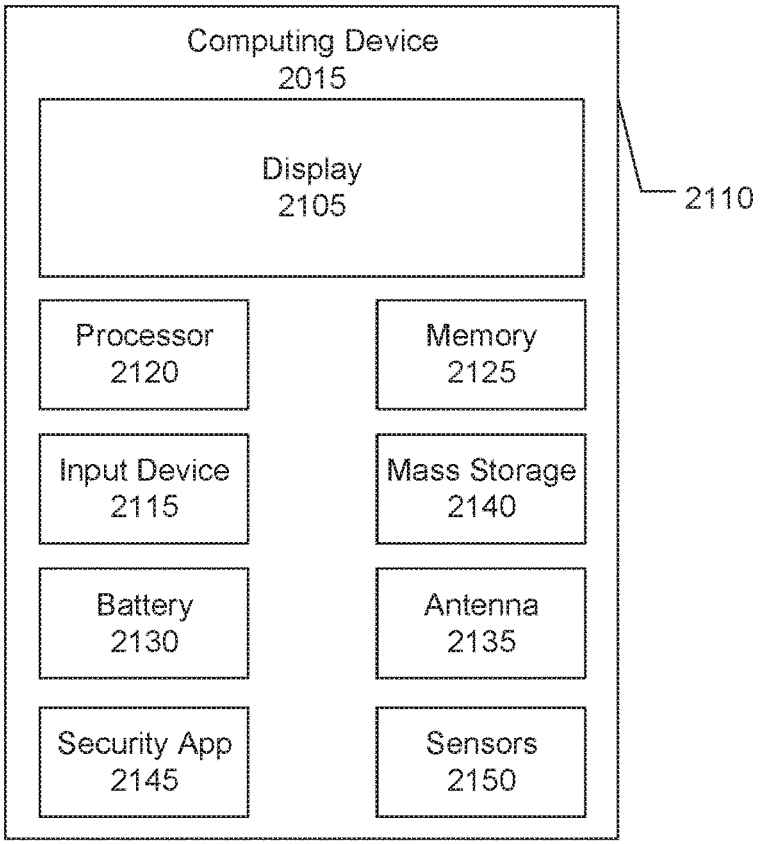
FIG. 21 is an exemplary block diagram of a computing device from the system of FIG. 20.

FIG. 21 is an exemplary block diagram of a computing device 2015 from the system of FIG. 20. In an embodiment, a user interfaces with the system through computing device 2015, which also receives data and performs the computational steps of the embodiments. Computing device 2015 may include a display, screen, or monitor 2105, housing 2110, input device 2115, sensors 2150, and a security application 2145. Housing 2110 houses familiar computer components, some of which are not shown, such as a processor 2120, memory 2125, battery 2130, speaker, transceiver, antenna 2135, microphone, ports, jacks, connectors, camera, input/output (I/O) controller, display adapter, network interface, mass storage devices 2140, and the like. In an embodiment, sensors 2150 may include sensors 2005, 2010, 2020, 2025, and 2035 in communication with computing device 2015

Input device 2115 may also include a touchscreen (e.g., resistive, surface acoustic wave, capacitive sensing, infrared, optical imaging, dispersive signal, or acoustic pulse recognition), keyboard (e.g., electronic keyboard or physical keyboard), buttons, switches, stylus, or combinations of these.

Display 2105 may include dedicated LEDs for providing directing signals and feedback to a user.

Mass storage devices 2140 may include flash and other nonvolatile solid-state storage or solid-state drive (SSD), such as a flash drive, flash memory, or USB flash drive. Other examples of mass storage include mass disk drives, floppy disks, magnetic disks, optical disks, magneto-optical disks, fixed disks, hard disks, CD-ROMs, recordable CDs, DVDs, recordable DVDs (e.g., DVD-R, DVD+R, DVD-RW, DVD+RW, HD-DVD, or Blu-ray Disc), battery-backed-up volatile memory, tape storage, reader, and other similar media, and combinations of these.

System 2100 may also be used with computer systems having configurations that are different from computing device 2015, e.g., with additional or fewer subsystems. For example, a computer system could include more than one processor (i.e., a multiprocessor system, which may permit parallel processing of information) or a system may include a cache memory. The computing device 2015 shown in FIG. 21 is but an example of a computer system suitable for use. For example, in a specific implementation, computing device 2015 is mounted to a vending machine and in communication with the sensors and positioning systems of the vending machine. Other configurations of subsystems suitable for use will be readily apparent to one of ordinary skill in the art.

The following paragraphs include enumerated embodiments.

1. An apparatus for a vending machine, comprising: an elongate divider; a first drive gear included at a first end of the elongate divider; a linear positioner in connection with the first drive gear; a carriage connected to the linear positioner; and an extender connected to the carriage, wherein: rotation of the first drive gear causes the linear positioner to move the carriage along the elongate divider between a first end of the elongate divider and a second end of the elongate divider.

2. The apparatus of embodiment 1, wherein the linear positioner includes: a) a belt running along the elongate divider between a drive pulley and an idler pulley and driven by the first drive gear; or b) a threaded shaft running along the elongate divider and driven by the first drive gear and a bevel gear.

3. The apparatus of claim 1, wherein the divider includes a product side, and an extension from the carriage is configured to sweep through a space adjacent to the product side with motion of the carriage along the elongate divider.

4. The apparatus of embodiment 3, wherein the extension is attached to the carriage using a first slot in the extension to engage a hook of the carriage.

5. The apparatus of embodiment 1, wherein: the linear positioner includes a belt running along the elongate divider between a drive pulley and an idler pulley and driven by the first drive gear; the drive pulley includes a coaxial second drive gear that engages the first drive gear; and the carriage includes a belt clamp, the belt clamp including a groove dimensioned to receive the belt and a flexible retainer that flexes from an initial position to admit the belt into the groove and returns to the initial position to retain the belt within the groove.

6. The apparatus of embodiment 5, wherein: the belt groove is non-linear, increasing friction between the belt and belt groove, and preventing movement of the carriage with respect to the belt; and the belt clamp further includes teeth at an edge of the belt groove, the teeth configured to partially retain the belt within the groove.

7. The apparatus of embodiment 1, wherein the divider includes: a front end cap and a rear end cap, the front end cap connected to the first end of the elongate divider and housing the first drive gear, the front end also including a first tab dimensioned to engage a corresponding slot in a shelf of the vending machine; and the rear end cap connected to the second end of the elongate divider and including a second tab dimensioned to engage a corresponding slot in the shelf.

8. The apparatus of embodiment 7, wherein: the linear positioner includes a belt running along the elongate divider between a drive pulley and an idler pulley and driven by the first drive gear; and the idler pulley is housed by the rear end cap with a spring urging the idler pulley away from the front end cap.

9. The apparatus of embodiment 1, wherein: the divider includes a non-product side; and the carriage includes a tab extending into a space adjacent the non-product side, the tab configured to interact with a position sensor of a moveable platform of the vending machine.

10. The apparatus of embodiment 1, wherein: the divider includes a magnet attached to the first end of the elongate divider, the magnet positioned to interact with a magnetic sensor of a moveable platform of the vending machine.

11. A kit for an apparatus for a vending machine, comprising: an elongate divider; a first drive gear included at a first end of the elongate divider; a linear positioner in connection with the first drive gear; a carriage connected to the linear positioner; and an extender connected to the carriage, wherein, when assembled: rotation of the first drive gear causes the linear positioner to move the carriage along the elongate divider between a first end of the elongate divider and a second end of the elongate divider.

12. The kit of embodiment 11, wherein, when assembled, the divider includes a product side, and an extension from the carriage is configured to sweep through a space adjacent to the product side with motion of the carriage along the elongate divider.

13. The kit of embodiment 11, wherein, when assembled: the linear positioner includes a belt running along the elongate divider between a drive pulley and an idler pulley and driven by the first drive gear; the drive pulley includes a coaxial second drive gear that engages the first drive gear; and the carriage includes a belt clamp, the belt clamp including a groove dimensioned to receive the belt and a flexible retainer that flexes from an initial position to admit the belt into the groove and returns to the initial position to retain the belt within the groove.

14. The kit of embodiment 13, wherein, when assembled: the belt groove is non-linear, increasing friction between the belt and belt groove, and preventing movement of the carriage with respect to the belt; and the belt clamp further includes teeth at an edge of the belt groove, the teeth configured to partially retain the belt within the groove.

15. The kit of embodiment 11, wherein the divider, when assembled, includes: a front end cap including a first tab dimensioned to engage a corresponding slot in a shelf of the vending machine; a rear end cap including a second tab dimensioned to engage a corresponding slot in the shelf; and wherein: the front end cap is connected to the first end of the elongate divider and houses the first drive gear; and the rear end cap is connected to the second end of the elongate divider.

16. The kit of embodiment 15, wherein: the linear positioner includes a belt running along the elongate divider between a drive pulley and an idler pulley and driven by the first drive gear; and the idler pulley is housed by the rear end cap with a spring urging the idler pulley away from the front end cap.

17. The kit of embodiment 11, wherein: the divider includes a non-product side; and the carriage includes a tab extending into a space adjacent the non-product side, the tab configured to interact with a position sensor of a moveable platform of the vending machine.

18. A method for dispensing product from a vending machine, comprising: providing on a shelf within the vending machine: an elongate divider, a first drive gear included at a first end of the elongate divider, a linear positioner in connection with the first drive gear, a carriage connected to the linear positioner, and an extender connected to the carriage; engaging the first drive gear with a second drive gear of a moveable platform; rotating the second drive gear, causing the first drive gear and linear positioner to move the carriage along the elongate divider between a first end of the elongate divider and a second end of the elongate divider, the movement of the carriage forcing a product onto the moveable platform.

19. The method of embodiment 18, wherein: the divider includes a product side; and the movement of the carriage causes the extender to sweep through a space adjacent to the product side, engage the product, and force the product into the moveable platform.

20. The method of embodiment 18, wherein: the divider includes a non-product side; and the carriage includes a tab extending into a space adjacent the non-product side, the tab configured to interact with a position sensor of the moveable platform, the method further comprising: receiving, by a controller from the position sensor, information regarding a position of the tab; and determining, by the controller based on the received position information, that the moveable platform is correctly positioned with respect to the divider.

21. The method of embodiment 18, wherein: the divider includes a non-product side; and the carriage includes a tab extending into a space adjacent the non-product side, the tab configured to interact with a position sensor of the moveable platform, the method further comprising: receiving, by a controller from the position sensor, information regarding a position of the tab; determining, by the controller based on the received position information, a distance to the tab; accessing, by the controller, a database containing information regarding a divider position associated with the divider, the information including a size of the product at the divider position; and determining, by the controller using the product size information and the position information, how many of the product are at the position associated with the divider.

22. A method for taking an inventory of a vending machine, comprises the following steps. First, providing on each shelf within the vending machine, at least one dispenser, each dispenser including: an elongate divider, a first drive gear included at a first end of the elongate divider, a linear positioner in connection with the first drive gear, a carriage connected to the linear positioner, and an extender connected to the carriage; wherein: the dispenser includes a non-product side, the carriage includes a tab extending into a space adjacent the non-product side, and the tab is configured to interact with a position sensor of a moveable platform of the vending machine. Second, receiving, by a controller of the vending machine from a database, information regarding each dispenser in the vending machine, the information including: a location of each dispenser, a product identifier for a product at each dispenser, and a size associated with the product at each dispenser. Third, positioning, by the controller using the location of each dispenser, the moveable platform at each dispenser and, while positioned at each dispenser: receiving, by the controller from the position sensor, information regarding a position of the tab; determining, by the controller based on the received position information, a distance to the tab; accessing, by the controller, the received information regarding the dispenser; and determining, by the controller using the product size information and the position information and the product identifier, a number of the identified products at the location of the dispenser. And fourth, combining, by the controller, the determined number of the identified products at each dispenser location to determine the total number of each product in the vending machine.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. An apparatus for a vending machine, comprising:

an elongate divider comprising a non-product side;

a first drive mechanism included at a first end of the elongate divider;

a linear positioner in connection with the first drive mechanism;

a carriage connected to the linear positioner, the carriage including a tab extending into a space adjacent the non-product side, the tab configured to interact with a position sensor of a moveable platform of the vending machine; and an extender connected to the carriage, wherein:

rotation of the first drive mechanism causes the linear positioner to move the carriage along the elongate divider between a first end of the elongate divider and a second end of the elongate divider.

2. The apparatus of claim 1, further comprising a database that automatically tracks inventory associated with the vending machine.

3. The apparatus of claim 1, wherein the linear positioner includes:

a. a belt running along the elongate divider between a drive pulley and an idler pulley and driven by the first drive mechanism; or b. a threaded shaft running along the elongate divider and driven by the first drive mechanism and a bevel mechanism.

4. The apparatus of claim 1, wherein:

the divider includes a magnet attached to the first end of the elongate divider, the magnet positioned to interact with a magnetic sensor of a moveable platform of the vending machine.

5. The apparatus of claim 1, wherein the elongated divider includes a product side, and an extension from the carriage is configured to sweep through a space adjacent to the product side with motion of the carriage along the elongate divider.

6. The apparatus of claim 5, wherein the extension is attached to the carriage using a first slot in the extension to engage a hook of the carriage.

7. The apparatus of claim 1, wherein:

the linear positioner includes a belt running along the elongate divider between a drive pulley and an idler pulley and driven by the first drive mechanism;

the drive pulley includes a coaxial second drive mechanism that engages the first drive mechanism; and the carriage includes a belt clamp, the belt clamp including a groove dimensioned to receive the belt and a flexible retainer that flexes from an initial position to admit the belt into the groove and returns to the initial position to retain the belt within the groove.

8. The apparatus of claim 7, wherein:

the belt groove is non-linear, increasing friction between the belt and belt groove, and preventing movement of the carriage with respect to the belt; and the belt clamp further includes teeth at an edge of the belt groove, the teeth configured to partially retain the belt within the groove.

9. The apparatus of claim 1, wherein the divider includes:

a front end cap and a rear end cap, the front end cap connected to the first end of the elongate divider and housing the first drive gear, the front end also including a first tab dimensioned to engage a corresponding slot in a shelf of the vending machine; and the rear end cap connected to the second end of the elongate divider and including a second tab dimensioned to engage a corresponding slot in the shelf.

10. The apparatus of claim 9, wherein:

the linear positioner includes a belt running along the elongate divider between a drive pulley and an idler pulley and driven by the first drive gear; and the idler pulley is housed by the rear end cap with a spring urging the idler pulley away from the front end cap.

11. A kit for an apparatus for a vending machine, comprising:

an elongate divider;

a first drive mechanism included at a first end of the elongate divider;

a linear positioner in connection with the first drive mechanism and including a belt at least partially extending along the elongate divider between a drive pulley and an idler pulley and driven by the first drive mechanism, the drive pulley including a second drive mechanism that engages the first drive mechanism;

a carriage connected to the linear positioner, the carriage including a belt clamp, the belt clamp including a groove dimensioned to receive the belt and a flexible retainer that flexes from an initial position to admit the belt into the groove and returns to the initial position to retain the belt within the groove; and an extender connected to the carriage, wherein, when assembled:

rotation of the first drive mechanism causes the linear positioner to move the carriage along the elongate divider between a first end of the elongate divider and a second end of the elongate divider.

12. The kit of claim 11, wherein:

the divider includes a non-product side; and the carriage includes a tab extending into a space adjacent the non-product side, the tab configured to interact with a position sensor of a moveable platform of the vending machine.

13. The kit of claim 11, wherein, when assembled, the divider includes a product side, and an extension from the carriage is configured to sweep through a space adjacent to the product side with motion of the carriage along the elongate divider.

14. The kit of claim 11, wherein, when assembled:

the belt groove is non-linear, increasing friction between the belt and belt groove, and preventing movement of the carriage with respect to the belt; and the belt clamp further includes teeth at an edge of the belt groove, the teeth configured to partially retain the belt within the groove.

15. The kit of claim 11, wherein the divider, when assembled, includes:

a front end cap including a first tab dimensioned to engage a corresponding slot in a shelf of the vending machine;

a rear end cap including a second tab dimensioned to engage a corresponding slot in the shelf; and wherein:

the front end cap is connected to the first end of the elongate divider and houses the first drive mechanism; and the rear end cap is connected to the second end of the elongate divider.

16. The kit of claim 15, wherein:

the linear positioner includes a belt running along the elongate divider between a drive pulley and an idler pulley and driven by the first drive mechanism; and the idler pulley is housed by the rear end cap with a spring urging the idler pulley away from the front end cap.

17. A method for dispensing product from a vending machine, comprising:

providing on a shelf within the vending machine:

an elongate divider, the elongate divider having a non-product side;

a first drive mechanism included at a first end of the elongate divider;

a linear positioner in connection with the first drive mechanism;

a carriage connected to the linear positioner and including a tab extending into a space adjacent the non-product side, the tab configured to interact with a position sensor of a moveable platform; and an extender connected to the carriage;

engaging the first drive mechanism with a second drive mechanism of the moveable platform;

rotating the second drive mechanism, causing the first drive mechanism and linear positioner to move the carriage along the elongate divider between a first end of the elongate divider and a second end of the elongate divider, the movement of the carriage forcing a product onto the moveable platform;

receiving, from the position sensor, information regarding a position of the tab; and determining, based on the received position information, that the moveable platform is correctly positioned with respect to the divider.

18. The method of claim 17, wherein:

the divider includes a product side; and the movement of the carriage causes the extender to sweep through a space adjacent to the product side, engage the product, and force the product into the moveable platform.

19. The method of claim 17, further comprising:

determining, based on the received position information, a distance to the tab;

accessing, a database containing information regarding a divider position associated with the divider, the information including a size of the product at the divider position; and determining, using the product size information and the position information, how many of the product are at the position associated with the divider.

20. A method for taking an inventory of a vending machine, comprising:

providing on each shelf within the vending machine, at least one dispenser, each dispenser including:

an elongate divider, a first drive mechanism included at a first end of the elongate divider, a linear positioner in connection with the first drive [[gear]] mechanism, a carriage connected to the linear positioner, and an extender connected to the carriage; wherein: the dispenser includes a non-product side, the carriage includes a tab extending into a space adjacent the non-product side, and the tab is configured to interact with a position sensor of a moveable platform of the vending machine.

receiving, by a controller of the vending machine from a database, information regarding each dispenser in the vending machine, the information including:

a location of each dispenser, a product identifier for a product at each dispenser, and a size associated with the product at each dispenser;

positioning, by the controller using the location of each dispenser, the moveable platform at each dispenser and, while positioned at each dispenser:

receiving, by the controller from the position sensor, information regarding a position of the tab;

determining, by the controller based on the received position information, a distance to the tab;

accessing, by the controller, the received information regarding the dispenser; and determining, by the controller using the product size information and the position information and the product identifier, a number of the identified products at the location of the dispenser; and combining, by the controller, the determined number of the identified products at each dispenser location to determine the total number of each product in the vending machine.

* * * * *